US008783938B2

(12) United States Patent
Alexander et al.

(10) Patent No.: US 8,783,938 B2
(45) **Date of Patent: *Jul. 22, 2014**

(54) LED LIGHT MODULE FOR USE IN A LIGHTING ASSEMBLY

(71) Applicant: Journée Lighting, Inc., Westlake Village, CA (US)

(72) Inventors: Clayton Alexander, Westlake Village, CA (US); Brandon S. Mundell, Austin, TX (US); Robert Rippey, III, Westlake Village, CA (US)

(73) Assignee: Journée Lighting, Inc., Westlake Village, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/854,854

(22) Filed: Apr. 1, 2013

(65) Prior Publication Data

US 2013/0215626 A1 Aug. 22, 2013

Related U.S. Application Data

(63) Continuation of application No. 12/855,550, filed on Aug. 12, 2010, now Pat. No. 8,414,178.

(60) Provisional application No. 61/233,327, filed on Aug. 12, 2009, provisional application No. 61/361,273, filed on Jul. 2, 2010.

(51) Int. Cl.
*H01R 33/00* (2006.01)
*F21V 29/00* (2006.01)

(52) U.S. Cl.
USPC ..... 362/655; 362/294; 362/649

(58) Field of Classification Search
USPC ..... 362/95, 655
See application file for complete search history.

(56) References Cited

U.S. PATENT DOCUMENTS 2,430,472 A 11/1947 Levy
D149,124 S 3/1948 Hewitt (Continued)

FOREIGN PATENT DOCUMENTS

CN 1536686 10/2004
JP U61-70306 5/1986

(Continued)

OTHER PUBLICATIONS

PCT International Search Report and the Written Opinion mailed Jun. 23, 2008, in related PCT Application No. PCT/US2007/023110.

(Continued)

*Primary Examiner* — Karabi Guharay
(74) *Attorney, Agent, or Firm* — Knobbe Martens Olson & Bear, LLP

(57) ABSTRACT

A lighting assembly includes a heat dissipating member, a socket and an LED light module removably coupleable to the socket. The socket has one or more electrical contact elements accessed via one or more slots in the socket such that they are protected from inadvertent human contact. The LED light module includes an LED lighting element and one or more electrical contact members that can extend into the one or more slots to releasably contact the one or more electrical contact elements, and establish an operative electrical connection, when the LED light module is coupled to the socket. One or more resilient members of the LED light module or socket gradually compress as the LED light module is axially inserted at least partially into the socket and then rotated relative to the socket such that the one or more electrical contact members move along the one or more slots into contact with the one or more electrical contact elements of the socket.

20 Claims, 28 Drawing Sheets

(56) References Cited

U.S. PATENT DOCUMENTS

| | | | |
|---|---|---|---|
| D152,113 | S | 12/1948 | Mehr |
| D191,734 | S | 11/1961 | Daher et al. |
| D217,096 | S | 4/1970 | Birns |
| 3,538,321 | A | 11/1970 | Keller et al. |
| 3,639,751 | A | 2/1972 | Pichel |
| 4,091,444 | A | 5/1978 | Mori |
| 4,453,203 | A | 6/1984 | Pate |
| 4,578,742 | A | 3/1986 | Klein et al. |
| 4,733,335 | A | 3/1988 | Serizawa et al. |
| 4,761,721 | A | 8/1988 | Willing |
| 4,872,097 | A | 10/1989 | Miller |
| D322,862 | S | 12/1991 | Miller |
| D340,514 | S | 10/1993 | Liao |
| 5,303,124 | A | 4/1994 | Wrobel |
| 5,337,225 | A | 8/1994 | Brookman |
| 5,634,822 | A | 6/1997 | Gunell |
| D383,236 | S | 9/1997 | Krogman |
| 5,909,955 | A | 6/1999 | Roorda |
| 6,072,160 | A | 6/2000 | Bahl |
| D437,449 | S | 2/2001 | Soller |
| D437,652 | S | 2/2001 | Uhler et al. |
| D443,710 | S | 6/2001 | Chiu |
| D446,592 | S | 8/2001 | Leen |
| D448,508 | S | 9/2001 | Benghozi |
| 6,341,523 | B2 | 1/2002 | Lynam |
| D457,673 | S | 5/2002 | Martinson et al. |
| 6,441,943 | B1 | 8/2002 | Roberts et al. |
| D462,801 | S | 9/2002 | Huang |
| D464,455 | S | 10/2002 | Fong et al. |
| D465,046 | S | 10/2002 | Layne et al. |
| 6,478,453 | B2 | 11/2002 | Lammers et al. |
| D470,962 | S | 2/2003 | Chen |
| D476,439 | S | 6/2003 | O'Rourke |
| 6,632,006 | B1 | 10/2003 | Rippel et al. |
| D482,476 | S | 11/2003 | Kwong |
| 6,682,211 | B2 | 1/2004 | English et al. |
| 6,703,640 | B1 | 3/2004 | Hembree et al. |
| 6,744,693 | B2 | 6/2004 | Brockmann et al. |
| 6,787,999 | B2 | 9/2004 | Stimac et al. |
| 6,824,390 | B2 | 11/2004 | Brown et al. |
| 6,864,513 | B2 | 3/2005 | Lin et al. |
| 6,871,993 | B2 | 3/2005 | Hecht |
| D504,967 | S | 5/2005 | Kung |
| 6,902,291 | B2 | 6/2005 | Rizkin et al. |
| 6,903,380 | B2 | 6/2005 | Barnett et al. |
| 6,905,232 | B2 | 6/2005 | Lin |
| 6,966,677 | B2 | 11/2005 | Galli |
| D516,229 | S | 2/2006 | Tang |
| D524,975 | S | 7/2006 | Oas |
| D527,119 | S | 8/2006 | Maxik et al. |
| 7,097,332 | B2 | 8/2006 | Vamberi |
| 7,111,963 | B2 | 9/2006 | Zhang |
| 7,111,971 | B2 | 9/2006 | Coushaine et al. |
| 7,132,804 | B2 | 11/2006 | Lys et al. |
| 7,138,667 | B2 | 11/2006 | Barnett et al. |
| 7,150,553 | B2 | 12/2006 | English et al. |
| 7,198,386 | B2 | 4/2007 | Zampini et al. |
| 7,207,696 | B1 | 4/2007 | Lin |
| D541,957 | S | 5/2007 | Wang |
| D544,110 | S | 6/2007 | Hooker et al. |
| D545,457 | S | 6/2007 | Chen |
| D564,119 | S | 3/2008 | Metlen |
| 7,344,279 | B2 | 3/2008 | Mueller et al. |
| 7,344,296 | B2 | 3/2008 | Matsui et al. |
| 7,357,534 | B2 | 4/2008 | Snyder |
| 7,396,139 | B2 | 7/2008 | Savage |
| 7,396,146 | B2 | 7/2008 | Wang |
| 7,413,326 | B2 | 8/2008 | Tain et al. |
| D577,453 | S | 9/2008 | Metlen |
| 7,452,115 | B2 | 11/2008 | Alcelik |
| D585,588 | S | 1/2009 | Alexander et al. |
| D585,589 | S | 1/2009 | Alexander et al. |
| 7,494,248 | B2 | 2/2009 | Li |
| 7,540,761 | B2 | 6/2009 | Weber et al. |
| 7,703,951 | B2 | 4/2010 | Piepgras et al. |
| 7,722,227 | B2 | 5/2010 | Zhang et al. |
| 7,740,380 | B2 | 6/2010 | Thrailkill |
| 7,744,266 | B2 | 6/2010 | Higley et al. |
| D626,094 | S | 10/2010 | Alexander et al. |
| 7,866,850 | B2 | 1/2011 | Alexander et al. |
| 7,874,700 | B2 | 1/2011 | Patrick |
| 7,972,054 | B2 | 7/2011 | Alexander et al. |
| 7,985,005 | B2 | 7/2011 | Alexander et al. |
| 8,052,310 | B2 | 11/2011 | Gingrinch, III et al. |
| 8,152,336 | B2 | 4/2012 | Alexander et al. |
| 8,177,395 | B2 | 5/2012 | Alexander et al. |
| 2002/0067613 | A1 | 6/2002 | Grove |
| 2003/0185005 | A1 | 10/2003 | Sommers et al. |
| 2004/0212991 | A1 | 10/2004 | Galli |
| 2005/0047170 | A1 | 3/2005 | Hilburger et al. |
| 2005/0122713 | A1 | 6/2005 | Hutchins |
| 2005/0146884 | A1 | 7/2005 | Scheithauer |
| 2005/0174780 | A1 | 8/2005 | Park |
| 2005/0242362 | A1 | 11/2005 | Shimizu et al. |
| 2006/0076672 | A1 | 4/2006 | Petroski |
| 2006/0146531 | A1 | 7/2006 | Reo et al. |
| 2006/0262544 | A1 | 11/2006 | Piepgras et al. |
| 2006/0262545 | A1 | 11/2006 | Piepgras et al. |
| 2007/0025103 | A1 | 2/2007 | Chan |
| 2007/0109795 | A1 | 5/2007 | Gabrius et al. |
| 2007/0242461 | A1 | 10/2007 | Reisenauer et al. |
| 2007/0253202 | A1 | 11/2007 | Wu et al. |
| 2007/0279921 | A1 | 12/2007 | Alexander et al. |
| 2007/0297177 | A1 | 12/2007 | Wang et al. |
| 2008/0013316 | A1 | 1/2008 | Chiang |
| 2008/0080190 | A1 | 4/2008 | Walczak et al. |
| 2008/0084700 | A1 | 4/2008 | Van De Ven |
| 2008/0106907 | A1 | 5/2008 | Trott et al. |
| 2008/0130275 | A1 | 6/2008 | Higley et al. |
| 2008/0158887 | A1 | 7/2008 | Zhu et al. |
| 2008/0274641 | A1 | 11/2008 | Weber et al. |
| 2009/0086474 | A1 | 4/2009 | Chou |
| 2009/0154166 | A1 | 6/2009 | Zhang et al. |
| 2009/0213595 | A1 | 8/2009 | Alexander et al. |
| 2010/0026158 | A1 | 2/2010 | Wu |
| 2010/0027258 | A1 | 2/2010 | Maxik et al. |
| 2010/0091487 | A1 | 4/2010 | Shin |
| 2010/0091497 | A1 | 4/2010 | Chen et al. |
| 2010/0102696 | A1 | 4/2010 | Sun |
| 2010/0127637 | A1 | 5/2010 | Alexander et al. |
| 2011/0096556 | A1 | 4/2011 | Alexander et al. |
| 2012/0218738 | A1 | 8/2012 | Alexander et al. |

FOREIGN PATENT DOCUMENTS

| | | | |
|---|---|---|---|
| JP | 2003-092022 | | 3/2003 |
| JP | 2004-179048 | | 6/2004 |
| JP | 2004-265626 | A | 9/2004 |
| JP | 2005-017554 | | 1/2005 |
| JP | 2005-071818 | | 3/2005 |
| JP | 2005-235778 | | 9/2005 |
| JP | 2005-267964 | | 9/2005 |
| JP | 2006-236796 | | 9/2006 |
| JP | 2006-253274 | | 9/2006 |
| JP | 2006-310138 | | 11/2006 |
| JP | 2007-273205 | | 10/2007 |
| JP | 2007-273209 | A | 10/2007 |
| TW | 2004 25542 | | 11/2004 |
| WO | WO DM/057383 | | 9/2001 |
| WO | WO 02/12788 | | 2/2002 |
| WO | WO 2004/071143 | | 8/2004 |
| WO | WO 2005/093862 | | 10/2005 |
| WO | WO 2007/128070 | A1 | 11/2007 |
| WO | WO 2008/108832 | | 9/2008 |

OTHER PUBLICATIONS

PCT International Search Report and the Written Opinion mailed Jun. 25, 2009, in related PCT Application No. PCT/US2009/035321.

International Search Report and Written Opinion as mailed on Jan. 19, 2010, received in PCT Application PCT/US09/64858.

International Search Report and Written Opinion mailed on Oct. 14, 2010 in PCT Application No. PCT/US2010/045361.

(56) References Cited

OTHER PUBLICATIONS

Non-final Office Action mailed on Jun. 12, 2009 in U.S. Appl. No. 11/715,071.
Non-final Office Action mailed on Jun. 25, 2010 in U.S. Appl. No. 12/149,900.
Non-final Office Action mailed on Sep. 7, 2010 in U.S. Appl. No. 11/715,271.
Non-final Office Action mailed on Sep. 19, 2011 in U.S. Appl. No. 12/409,409.
Non-final Office Action mailed on Dec. 15, 2011 in U.S. Appl. No. 13/175,376.
Non-final Office Action mailed on Feb. 1, 2013 in U.S. Appl. No. 13/464,191.
Allowed claims as allowed on Apr. 29, 2011 in U.S. Appl. No. 12/986,934.
Chinese Office Action issued on Mar. 16, 2012, received Mar. 26, 2012 in CN Application No. 200980107047.5.
Office Action mailed on Oct. 22, 2012 received in Chinese Application No. 200780052022.0.
Office Action mailed on Oct. 24, 2012 received in Chinese Application No. 200980107047.5.
Second Chinese Office Action mailed on Apr. 6, 2012 in Chinese Application No. 200780052022.0.
Extended European Search Report mailed on Nov. 28, 2012 in EP Application No. 07861639.8.
Non-final Office Action mailed on May 21, 2012 received in Japanese Application No. 2009-552663.
Office Action mailed on Mar. 19, 2013, received in Japanese Application No. 2009-552663.
Office Action mailed on Jun. 4, 2013 in Japanese Patent Application No. 2010-548873.
Office Action mailed on Jul. 2, 2013 in Chinese Patent Application No. 200980107047.5.
Office Action mailed on Jan. 16, 2014 in CA Application No. 2,682,389.
Office Action mailed on Dec. 13, 2013 in EP Application No. 07861369.8.

LED LIGHT MODULE FOR USE IN A LIGHTING ASSEMBLY

CROSS-REFERENCE TO RELATED APPLICATIONS

This is a continuation application of U.S. application Ser. No. 12/855,550, filed Aug. 12, 2010, which claims the benefit of U.S. Provisional Patent Application Nos. 61/233,327 filed Aug. 12, 2009 and 61/361,273 filed Jul. 2, 2010, the entire contents of all of which are incorporated herein by reference and should be considered a part of this specification.

BACKGROUND

1. Field

The present invention is directed to an LED light module that can be removably coupled thermally and electrically to a heat sink or lighting assembly.

2. Description of the Related Art

Lighting assemblies such as ceiling lights, recessed lights, and track lights are important fixtures in many homes and places of business. Such assemblies are used not only to illuminate an area, but often also to serve as a part of the decor of the area. However, it is often difficult to combine both form and function into a lighting assembly without compromising one or the other.

Traditional lighting assemblies typically use incandescent bulbs. Incandescent bulbs, while inexpensive, are not energy efficient, and have a poor luminous efficacy. To address the shortcomings of incandescent bulbs, there is a movement to use more energy-efficient and longer lasting sources of illumination, such as fluorescent bulbs, high-intensity discharge (HID) bulbs, and light emitting diodes (LEDs). Fluorescent bulbs and HID bulbs require a ballast to regulate the flow of power through the bulb, and thus can be difficult to incorporate into a standard lighting assembly. Accordingly, LEDs, formerly reserved for special applications, are increasingly being considered as a light source for more conventional lighting assemblies.

LEDs offer a number of advantages over incandescent, fluorescent, and HID bulbs. For example, LEDs produce more light per watt than incandescent bulbs, LEDs do not change their color of illumination when dimmed, and LEDs can be constructed inside solid cases to provide increased protection and durability. LEDs also have an extremely long life span when conservatively run, sometimes over 100,000 hours, which is twice as long as the best fluorescent and HID bulbs and twenty times longer than the best incandescent bulbs. Moreover, LEDs generally fail by a gradual dimming over time, rather than abruptly burning out, as do incandescent, fluorescent, and HID bulbs. LEDs are also desirable over fluorescent bulbs due to their decreased size, lack of need for a ballast, and their ability to be mass produced and easily mounted onto printed circuit boards.

While LEDs have various advantages over incandescent, fluorescent, and HID bulbs, the widespread adoption of LEDs has been hindered by the challenge of how to properly manage and disperse the heat that LEDs emit. The performance of an LED often depends on the ambient temperature of the operating environment, such that operating an LED in an environment having a moderately high ambient temperature can result in overheating the LED and premature failure of the LED. Moreover, operation of an LED for an extended period of time at an intensity sufficient to fully illuminate an area may also cause an LED to overheat and prematurely fail.

Accordingly, high-output LEDs require direct thermal coupling to a heat sink device in order to achieve the advertised life expectancies from LED manufacturers. This often results in the creation of an LED sub-assembly that is not upgradeable or replaceable within a given lighting assembly. For example, LEDs are traditionally permanently coupled to a heat dissipating fixture housing, requiring the end-user to discard the entire lighting assembly after the end of the LED's usable life or if there should be a malfunction of the LED.

Additionally, conventional LED light assemblies that are removable generally engage a lighting assembly with exposed electrical contacts, which can be inadvertently touched by a user. Such exposed electrical contacts can pose a safety risk to users where the voltage provided to the LED assembly is high (e.g., 110V line voltage).

Accordingly, there is a need for an improved LED light module that addresses at least one of the drawbacks of conventional LED assemblies noted above.

SUMMARY

In accordance with another embodiment, a lighting assembly is provided, comprising a socket attachable to a heat dissipating member, said socket comprising one or more electrical contact elements accessed via one or more openings in the socket, said one or more openings extending along at least a portion of a circumference of the socket. The lighting assembly further comprises an LED light module removably coupleable to the socket. The LED light module comprises an LED lighting element and one or more electrical contact members configured to extend into the one or more openings in the socket to releasably contact the one or more electrical contact elements of the socket when the LED light module is coupled to the socket, said LED light module electrical contact members configured such that they will establish an operative electrical connection with the socket. The lighting assembly further comprises one or more resilient members of the LED light module or socket configured to apply a force between the LED light module and a least a portion or an element of the heat dissipating member when the LED light module is axially inserted at least partially into the socket such that the one or more electrical contact members extend into the one or more openings and when the LED light module is rotated relative to the socket, following said axial insertion, such that the one or more electrical contact members move along the one or more openings to thereby contact the one or more electrical contact elements of the socket.

In accordance with another embodiment, a lighting assembly is provided, comprising a heat dissipating member and a socket attachable to the heat dissipating member, said socket comprising one or more electrical contact elements accessed via one or more openings in the socket. The lighting assembly also comprises an LED light module removably coupleable to the socket. The LED light module comprises an LED lighting element and one or more electrical contact members configured to extend into the one or more openings in the socket to releasably contact the one or more electrical contact elements of the socket when the LED light module is coupled to the socket, said LED light module electrical contact members configured to establish an operative electrical connection with the socket. The lighting assembly further comprises one or more resilient members of the LED light module or socket configured to gradually compress as the LED light module is axially inserted at least partially into the socket and then rotated relative to the socket such that the one or more electrical contact members move along the one or more openings into contact with the one or more electrical contact elements of the socket. The one or more resilient members are configured to apply a force between the LED light module and a least a portion or an element of the heat dissipating member during one or both of said axial insertion and/or rotation of the LED light module relative to the socket.

DETAILED DESCRIPTION

Figure 1B:
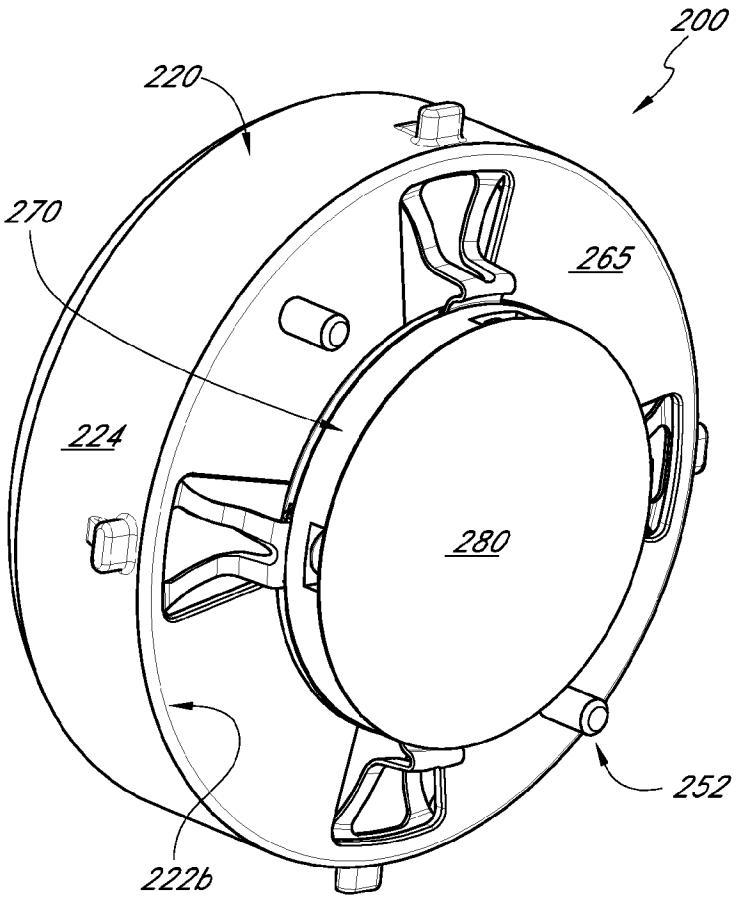
FIG. 1B is a schematic perspective rear view of the LED light module of FIG. 1A.
Figure 1A:
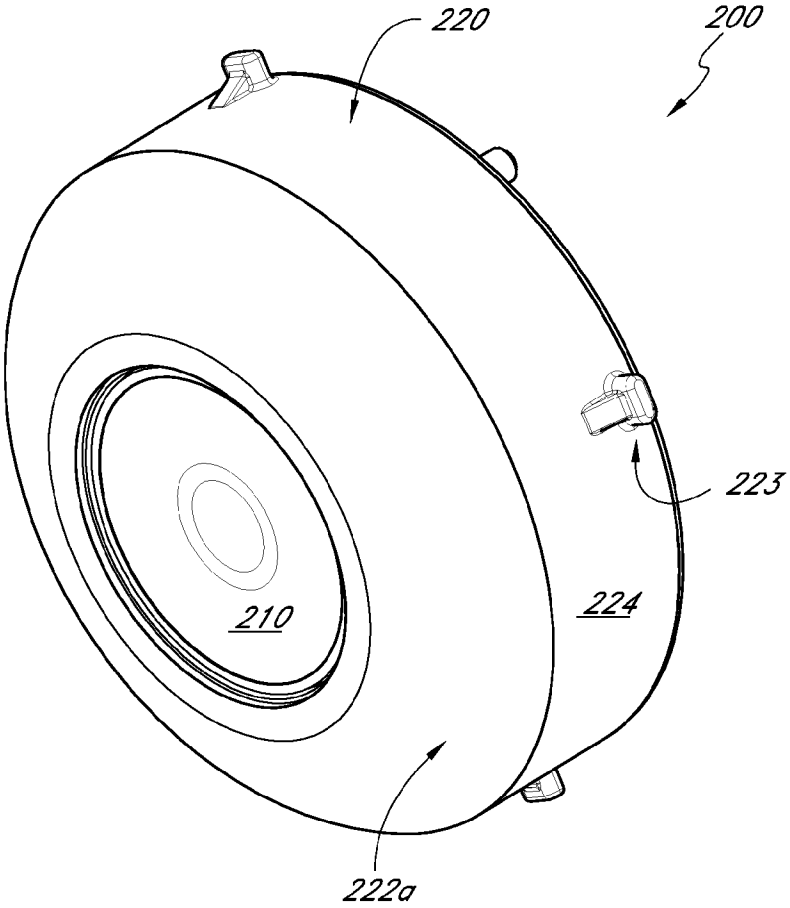
FIG. 1A is a schematic perspective front view of one embodiment of an LED light module.
Figure 1C:
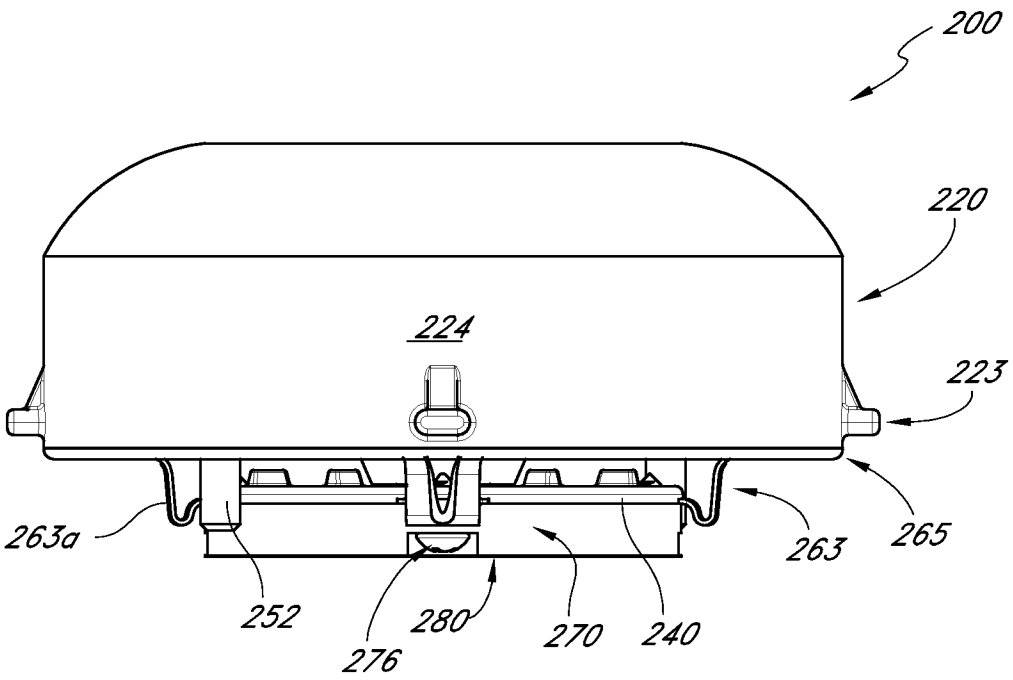
FIG. 1C is a schematic side view of the LED light module of FIG. 1A.

FIGS. 1A-3B show one embodiment of an LED light module 200. The LED light module assembly 200 can include an optic 210; a housing 220; an optic retainer 230; an LED driver printed circuit board (PCB) 250; a lighting element, such as an LED 290; a lower retaining member 240, a resilient member 260, an upper retaining member 265, a thermal interface member 270; and a thermal pad 280.

Figure 2A:
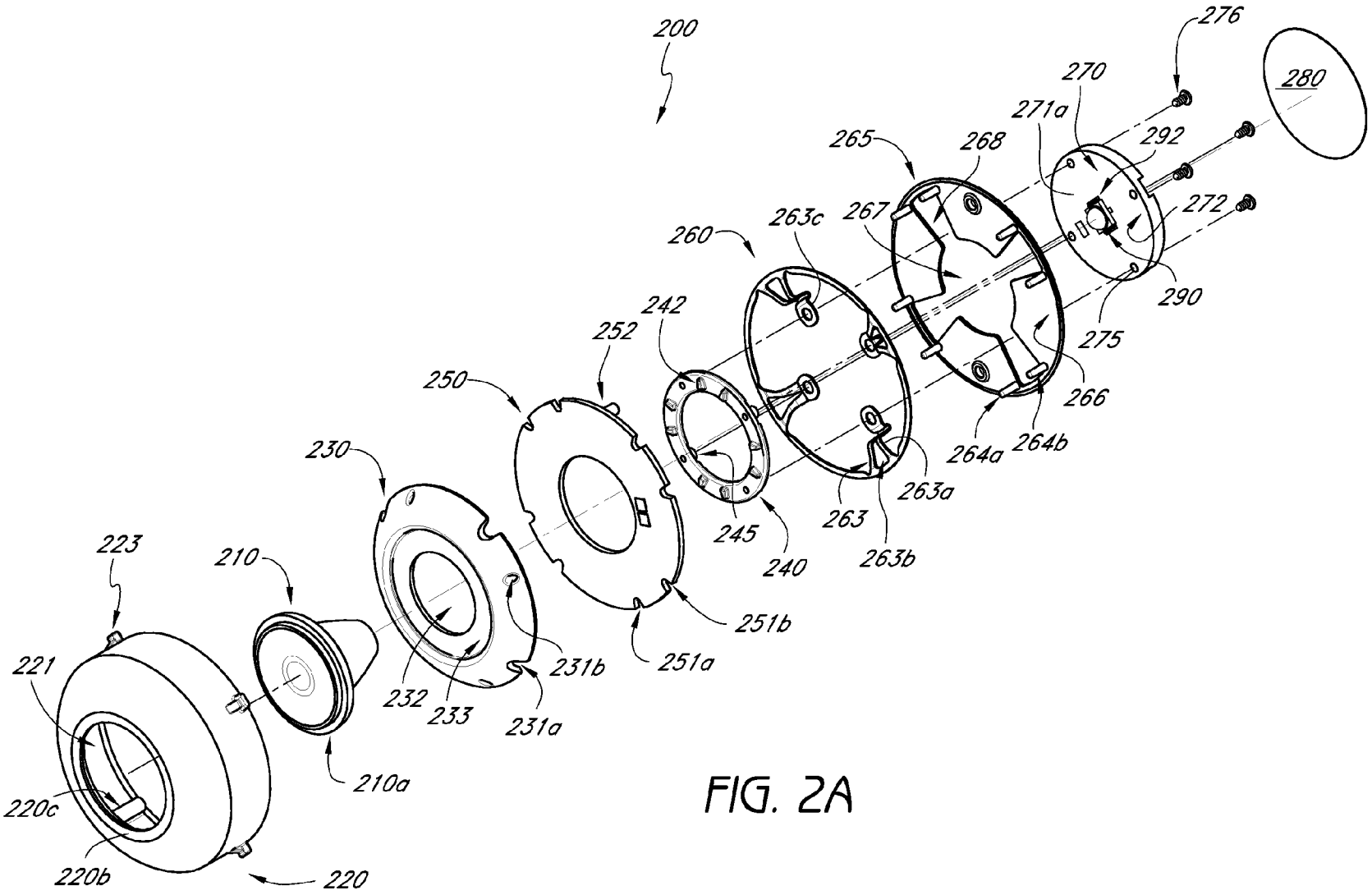
FIG. 2A is a schematic perspective front exploded view of the LED light module of FIG. 1A.
Figure 2B:
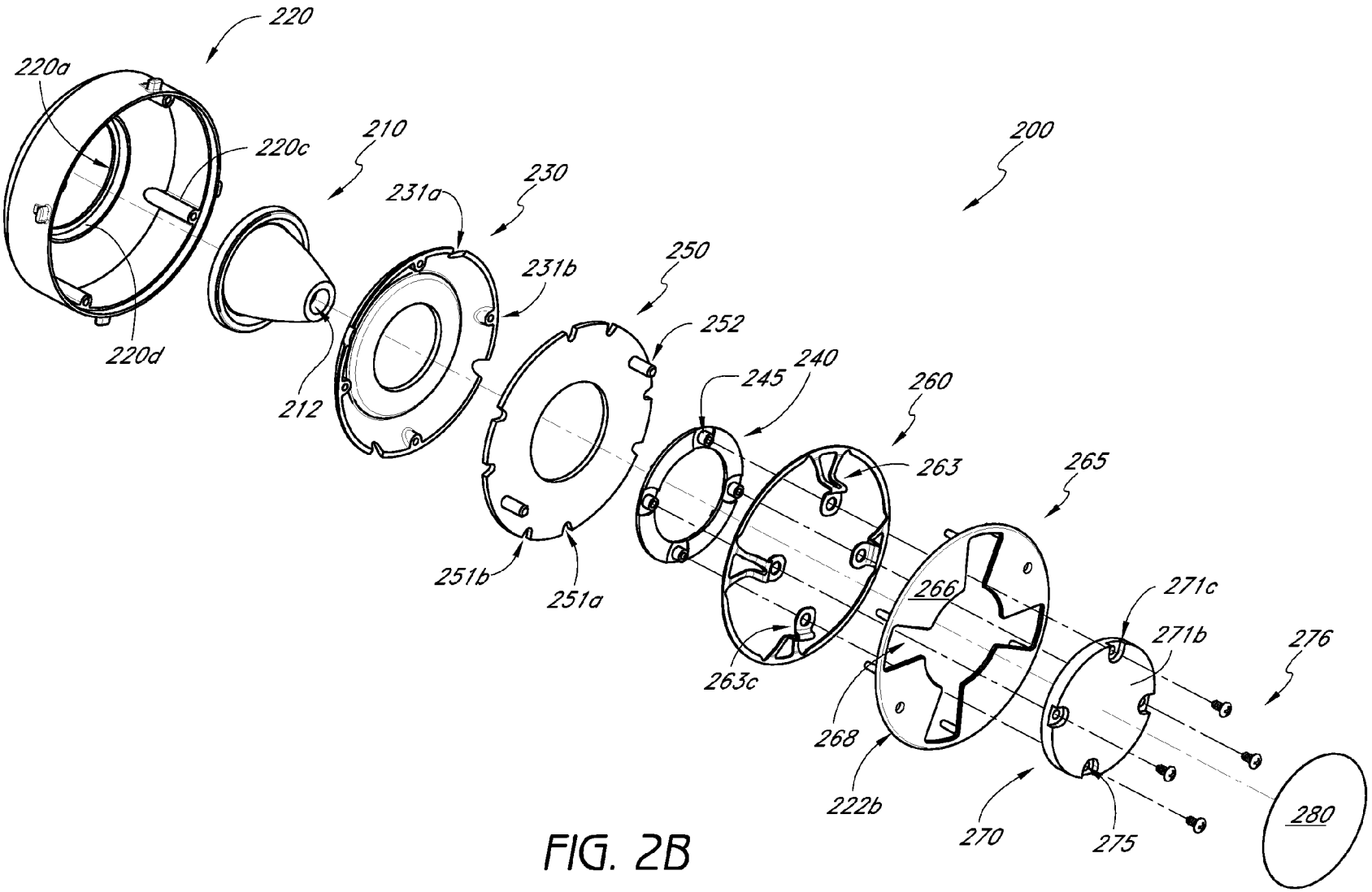
FIG. 2B is a schematic perspective rear exploded view of the LED light module of FIG. 1A.
Figure 3B:
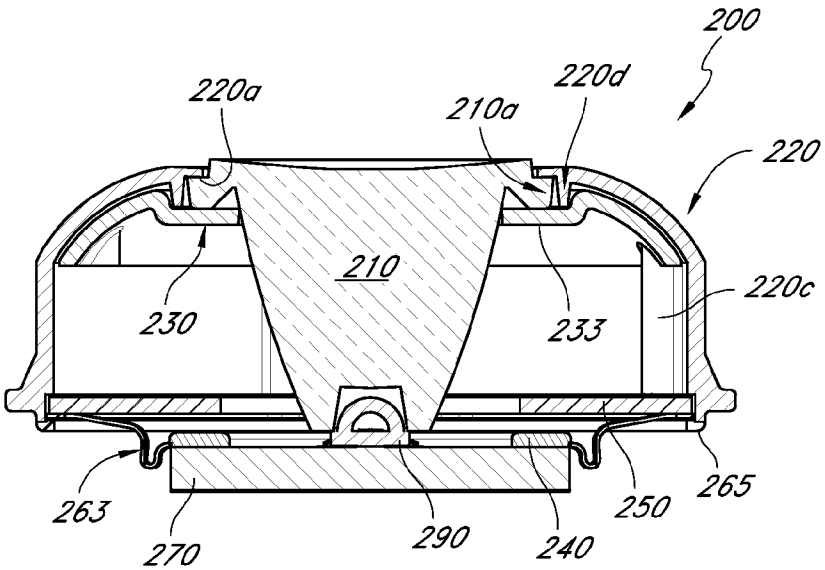
FIG. 3B is a schematic cross-sectional side view of the LED light module of FIG. 1A in a compressed position.
Figure 3A:
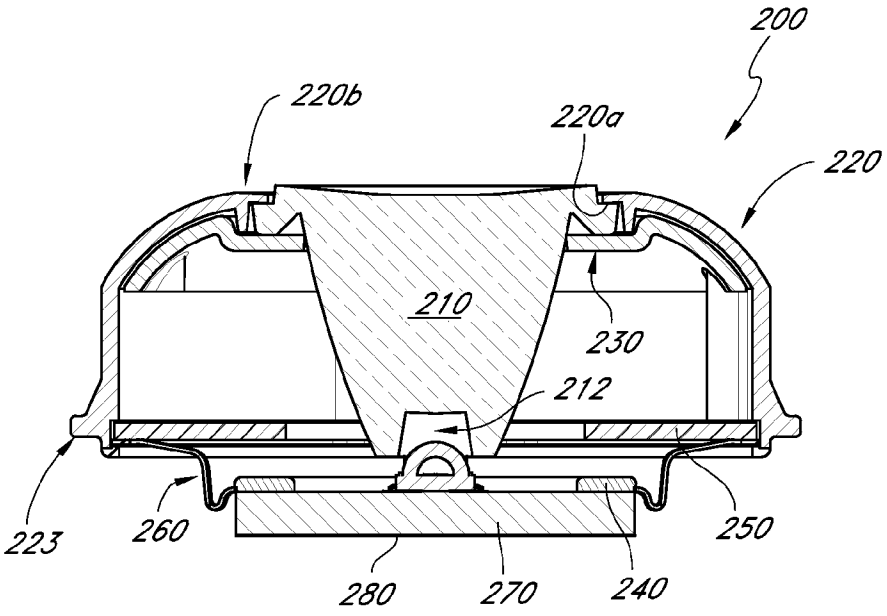
FIG. 3A is a schematic cross-sectional side view of the LED light module of FIG. 1A in an uncompressed position.

The housing 220 can include an opening 221 (see FIG. 2A) sized to receive the optic 210 at least partially therein, which can be removably fixed to the housing 220 by the optic retainer 230 such that a rim or shoulder 210*a* of the optic 210 is disposed against an underside surface 220*a* of shoulder 220*b* (see FIG. 2B-3B) of the opening 221. The optic retainer 230 can have an opening 232 through which at least a portion of the optic 210 can extend. The optic retainer 230 can also have a recessed annular shelf 233 that the shoulder 210*a* of the optic 210 abuts against. In the illustrated embodiment, the optic 210 can advantageously be readily disengaged from the housing 220 and removed from the LED light module 200 by withdrawing the optic 210 from housing 220 because the optic 210 is held against the shoulder 220*b* by the retainer 230, but not otherwise coupled to the housing 220. In another embodiment, the optic 210 can be releasably coupled to the housing 220 via fasteners (e.g., hooks), and can be readily decoupled from the housing 220. Accordingly, the optic 210 can be easily removed and replaced with another optic, for example, to provide a different angle of illumination (e.g., narrow or wide) for the LED light module 200. As best shown in FIGS. 2A and 3A-3B, the optic 210 can extend at least partially through a central opening in the circuit board 250. In another embodiment, the optic 210 can be excluded from the LED light module 200.

Figure 12:
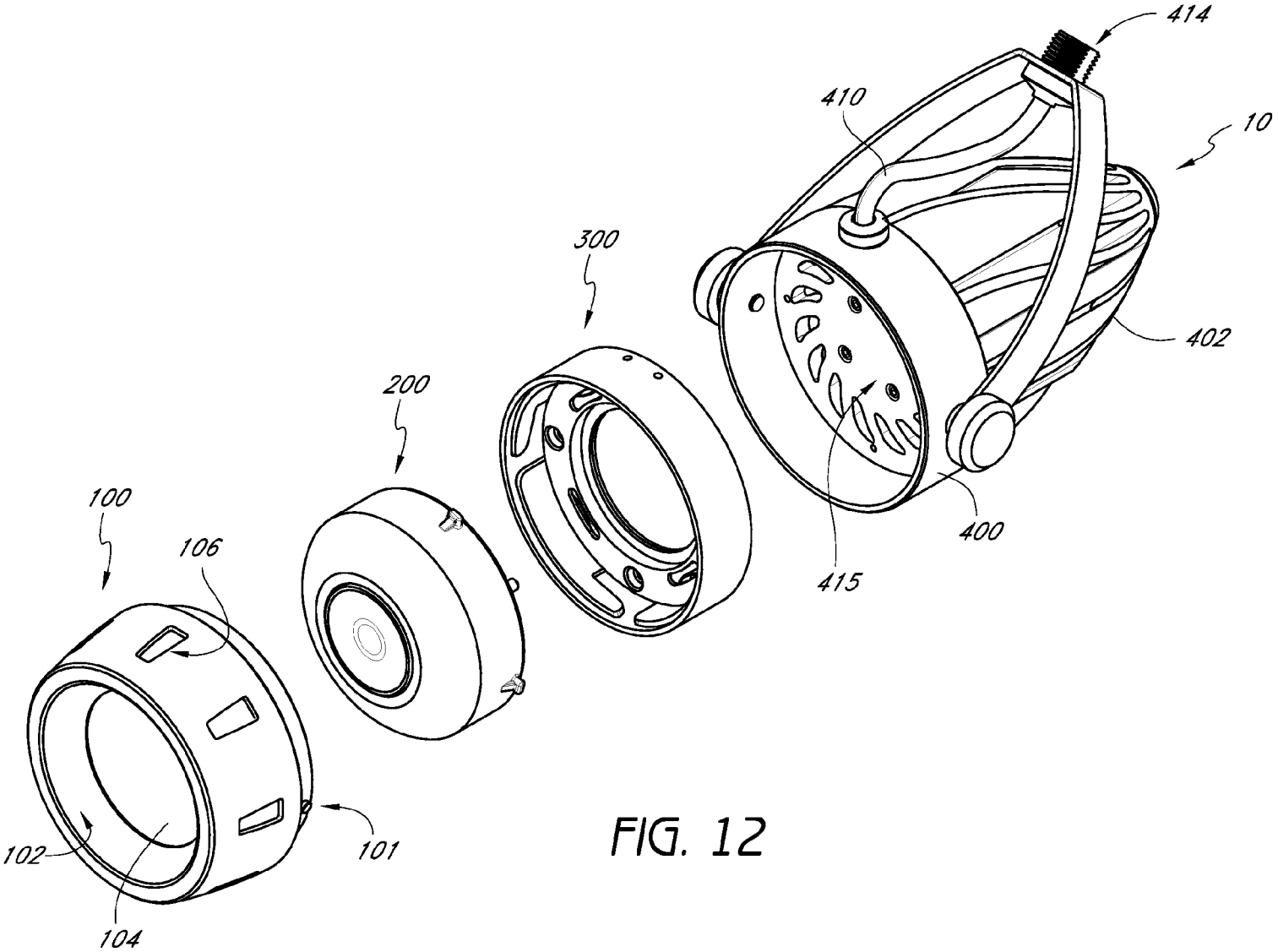
FIG. 12 is a schematic perspective front exploded view of an LED light module and socket coupled to one embodiment of a lighting assembly.
Figure 13A:
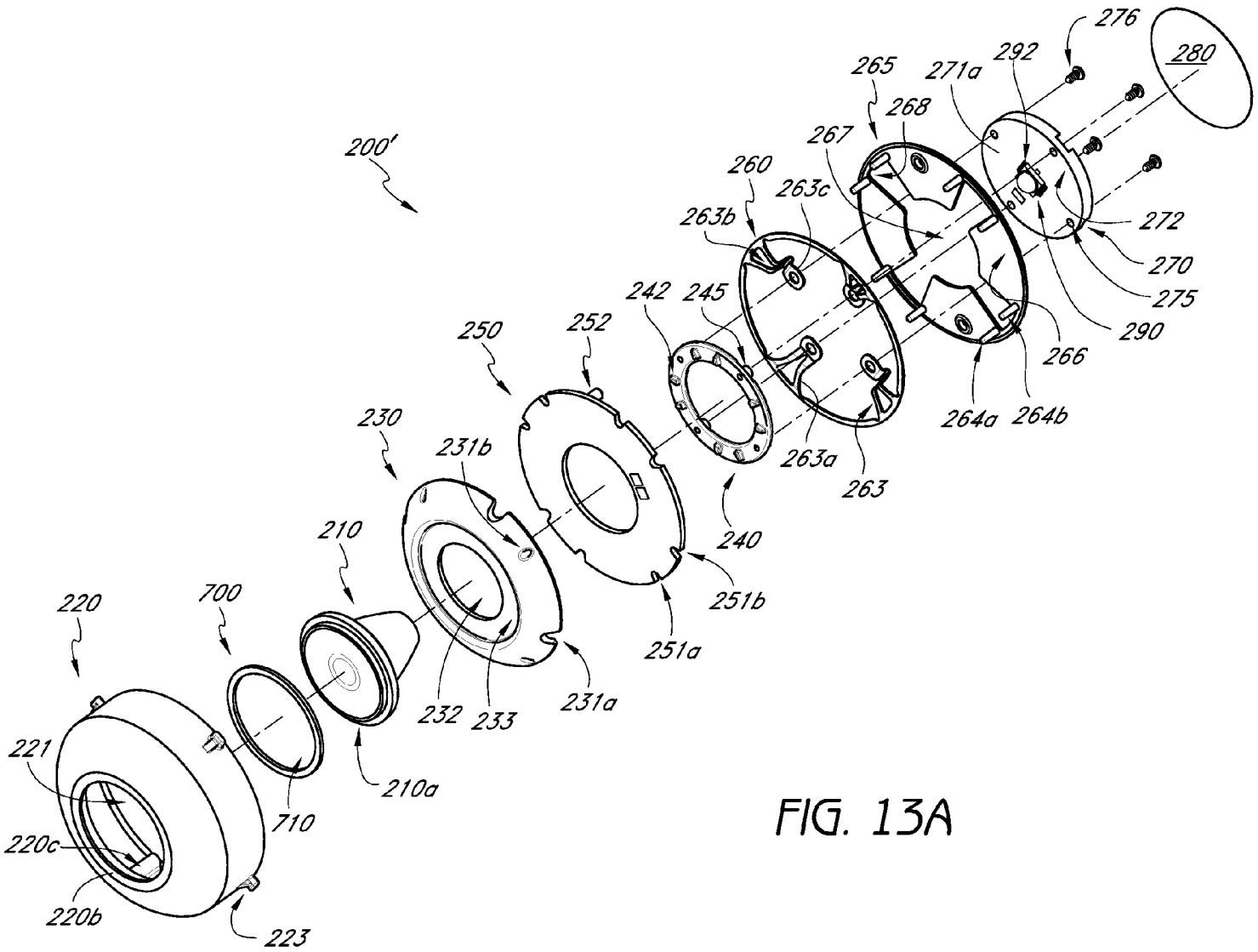
FIG. 13A is a schematic perspective front exploded view of another embodiment of an LED light module.
Figure 13B:
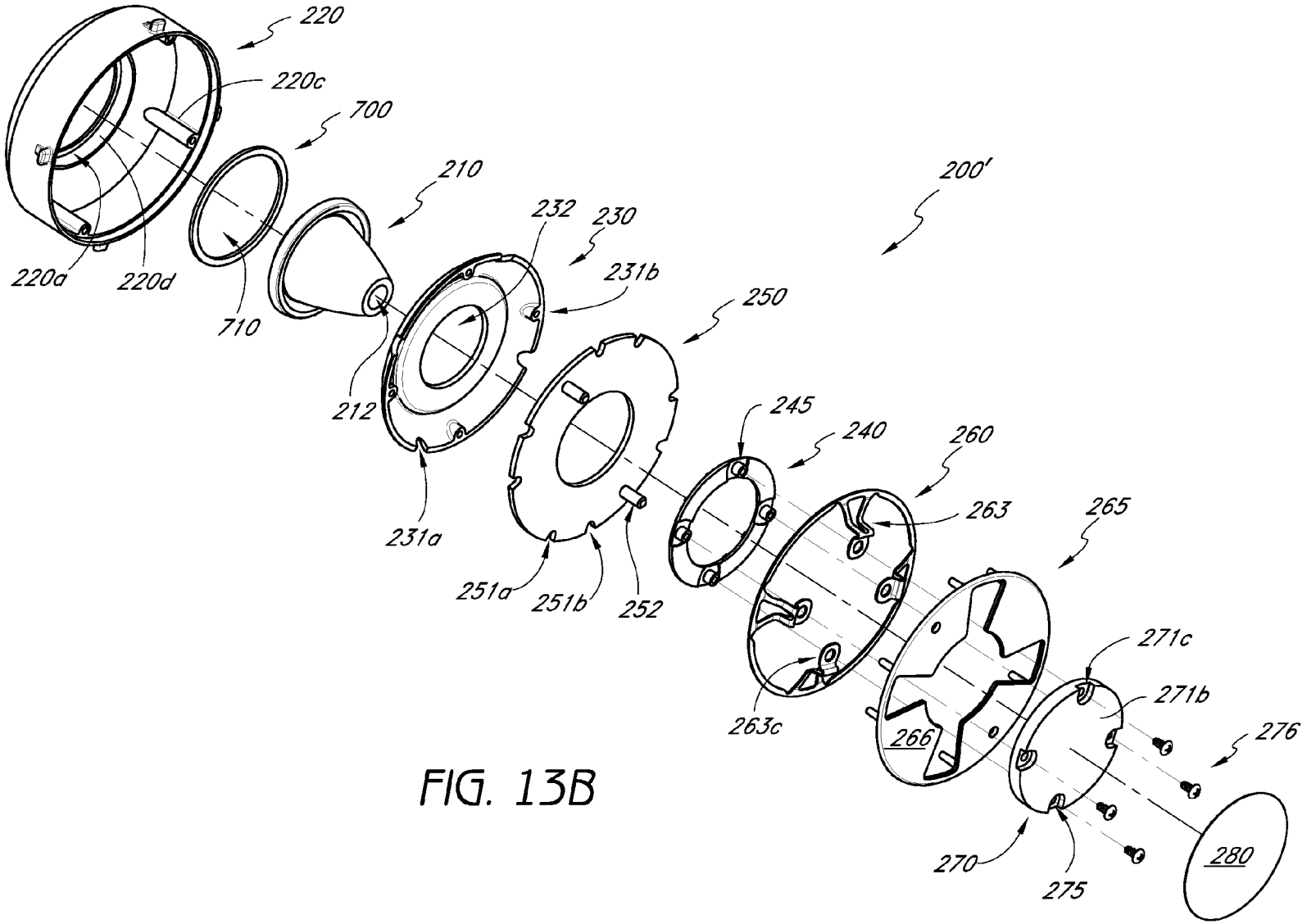
FIG. 13B is a schematic perspective rear exploded view of the LED light module of FIG. 13A.

In one embodiment, the housing 220 can also include one or more apertures (not shown) formed circumferentially about the opening 221 to facilitate air flow into the LED light module 200 to, for example, ventilate the printed circuit board 250, LED 290, and/or a thermally-conductive housing 400 of a lighting assembly, such as the receiving lighting assembly 10 in which the LED light module 200 is at least partially received (see FIG. 12). Additionally, the number, shape and/or location of such apertures can also be varied in other embodiments. In the embodiment illustrated in FIGS. 1-3B, such airflow apertures are omitted.

The housing 220 can also include one or more engaging members 223, such as protrusions or tabs, on its outer surface 224. In the illustrated embodiment, the housing 220 has four engaging members 223. However, in other embodiments the housing 220 can include fewer or more engaging members 223. In the illustrated embodiment, the engaging members 223 are shown as being "t-shaped" tabs, but the engaging members 223 can have any suitable shape (e.g., L-shaped, J-shaped), and can be positioned on other surfaces of the LED light module 200, such as the bottom surface 222*b* of the LED light module 200 opposite a front surface 222*a* of the housing 220. In one embodiment (not shown), the engaging members 223 can be spring loaded (e.g., spring loaded relative to the outer surface 224 or bottom surface 222*b* of the upper retaining member 265), so that the engaging members 223 generate a compression force when the LED light module 200 is coupled to a socket, such as the socket 300 in FIG. 4, that urges the thermal interface member 270 into contact with a thermally conductive surface (e.g., of the socket, a heat sink or heat dissipating member, or of a thermally conductive housing), which establishes a thermal path between the LED 290 and at least a portion of the lighting assembly 10 (e.g., a portion of the socket, a heat sink or heat dissipating member, or of a thermally conductive housing) to dissipate heat from the LED 290.

With continued reference to FIGS. 1A-3B, the resilient member 260 can include one or more resilient elements 263, which can include resilient ribs or springs 263*a*. In the illustrated embodiment, the resilient member 260 includes four resilient elements 263. However, in other embodiments, the resilient member 260 can include more or fewer resilient elements 263. Additionally, in the illustrated embodiment, the resilient element 263 has a wishbone-like shape and functions as a leaf spring. However the resilient element 263 can have other suitable shapes. In one embodiment, the resilient element 263 can be made of the same material as the rest of the resilient member 260. In another embodiment, the resilient element 263 can be made of a different material than the rest of the resilient member 260. In one embodiment, the resilient element 263 can be made of metal, such as stamped stainless steel. However, the resilient element 263 can be made of other suitable materials, such as a plastic material, including a shape memory plastic material. In one embodiment, the resilient member 260 can be formed of any plastic or resin material such as, for example, polybutylene terephthalate. In another embodiment, the resilient member 260 can be formed of, for example, nylon and/or thermally conductive plastics such as plastics made by Cool Polymers, Inc., known as CoolPoly®. However, other suitable materials, including metallic materials, can be used.

Figure 9A:
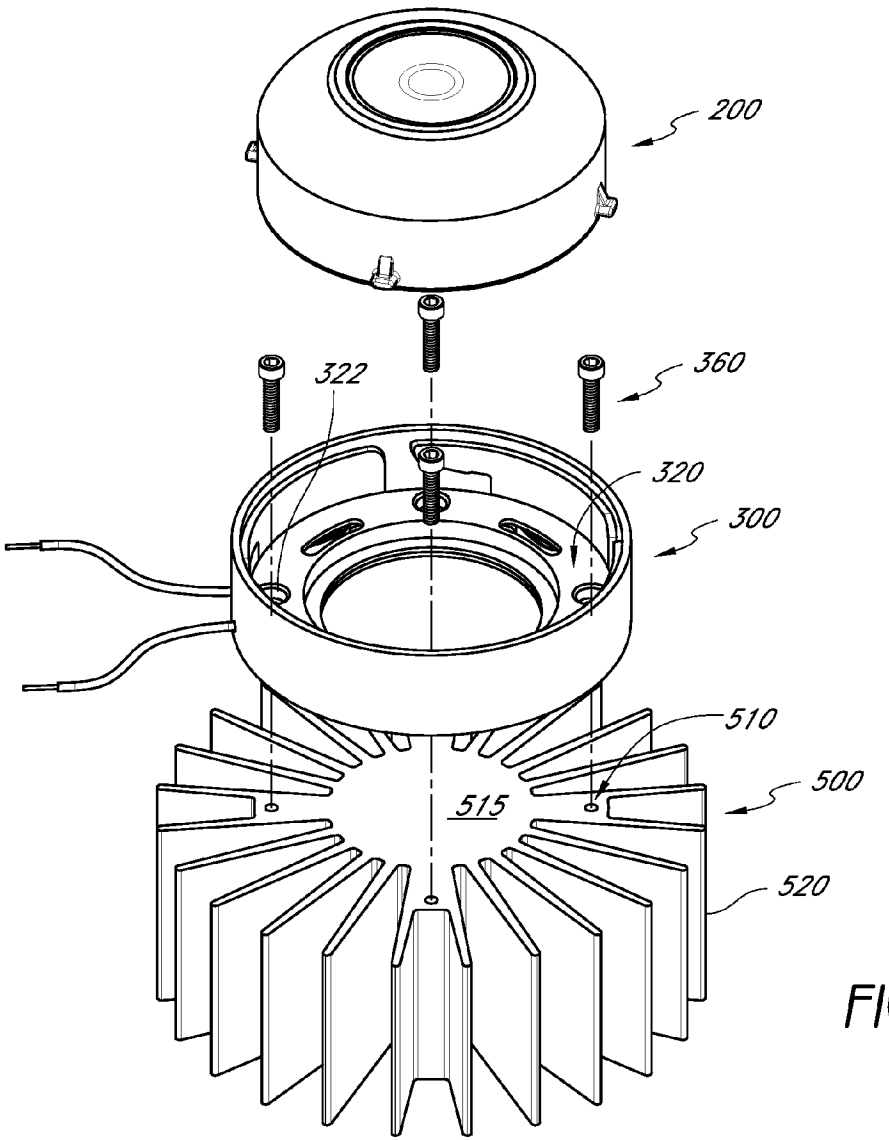
FIG. 9A is a schematic perspective exploded top view of an LED light module aligned with the socket of FIG. 4 or 8 and one embodiment of a heat sink or heat dissipating member.
Figure 9B:
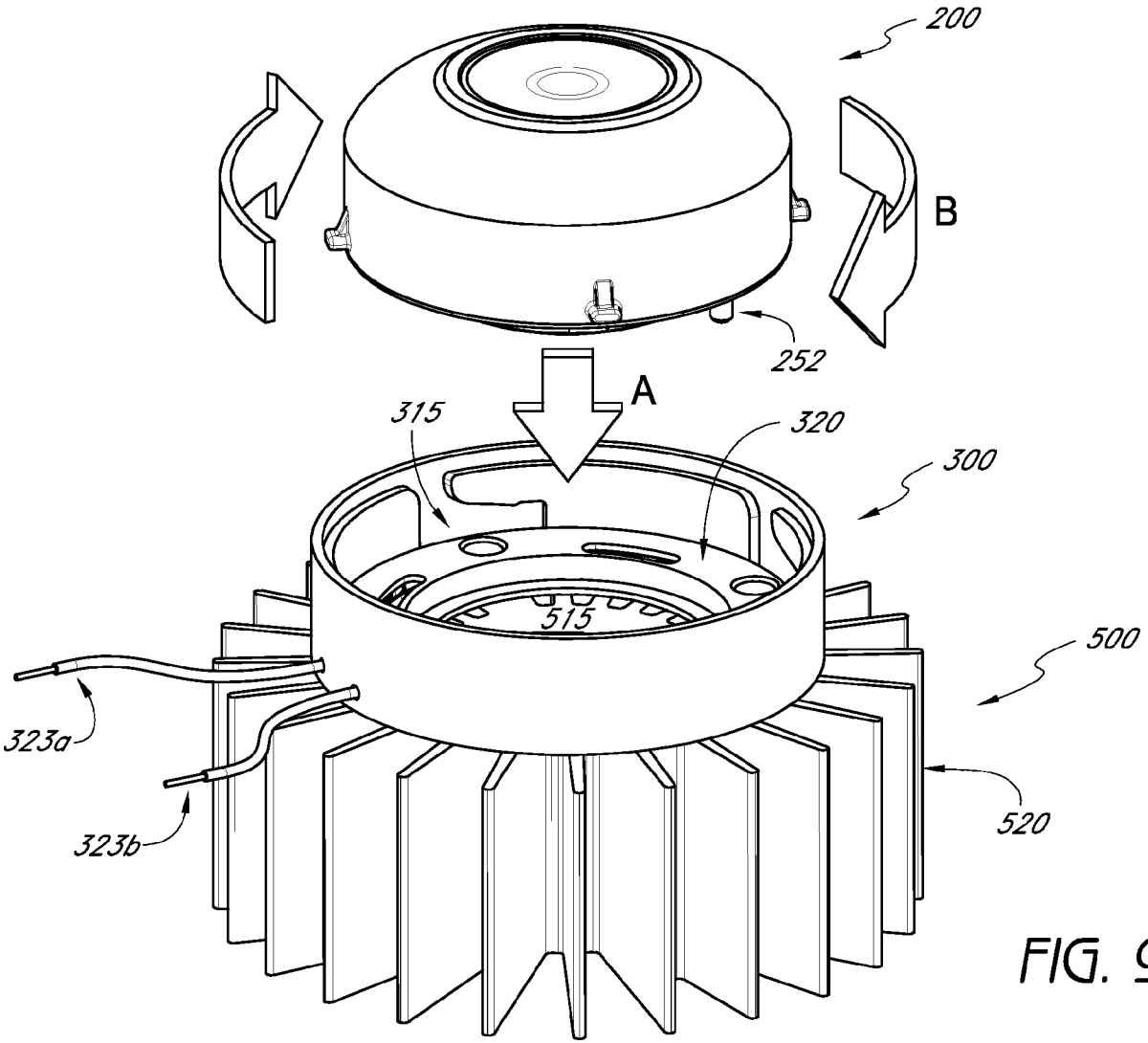
FIG. 9B is a schematic perspective top view of an LED light module aligned with the socket of FIG. 8 attached to a heat sink or heat dissipating member, illustrating the process for coupling the LED light module to the socket and heat sink.

The thickness and width of the resilient element 263 can be adjusted in different embodiments to increase or decrease the spring force provided by the resilient element 263. The resilient element 263 can include an opening 263*b* between the ribs 263*a* that can have any suitable size or shape to, for example, adjust the flexibility of the resilient element 263. The resilient elements 263 in the resilient member 260 provide the desired spring force to generate a compression force between the LED light module 200 and a socket, such as the socket 300 in FIG. 4, a heat dissipating member, such as the heat sink 500 of FIG. 9A, or a thermally-conductive housing, such as the housing 400 (see FIG. 12). The compression force creates a resilient thermal coupling between, for example, the LED light module 200 and the socket, heat sink and/or thermally-conductive housing 400 so that heat can be effectively dissipated from the LED light module 200 to the socket, heat sink, and/or thermally conductive housing. In another embodiment, a gasket (e.g., annular gasket) of resilient material can be disposed adjacent the lower retaining member 240 so that the gasket provides an interface between the lower retaining member 240 and a portion of the circuit board 250. Said gasket can also provide a compression force, in addition to the compression force provided by the resilient elements 263, to achieve the desired thermal coupling between the LED light module 200 and the thermally-conductive housing 400 via the socket 300. In another embodiment (not shown), the compression force between, for example, the LED light module 200 and the thermally-conductive housing 400 can be provided solely by a gasket between the lower retaining member 240 and the circuit board 250, and the resilient elements 263 can be omitted.

In one embodiment, the lower retaining member 240 can have one or more compression limiter tabs 242 to limit the deflection of the resilient elements 263 when the lower retaining member 240 is moved toward the printed circuit board 250 (e.g., via the movement of the thermal interface member 270 when the LED light module 200 is coupled to the socket 300) to thereby maintain the resiliency and elasticity of the resilient elements 263 and inhibit the over-flexing (e.g., plastic deformation) of the resilient elements 263. As shown in FIGS. 3A-3B, the optic 210 can engage the LED 290 when the LED light module 200 is moved into the compressed position (see FIG. 3B) via the coupling of the LED light module 200 to the socket 300. This limits the travel of the lower retaining member 240 relative to the printed circuit board 250 and inhibits the over-flexing of the resilient elements 263. Further details on compression limiter tabs and LED light assemblies can be found in U.S. application Ser. No. 12/409,409, filed Mar. 23, 2009, the contents of which are incorporated herein by reference in their entirety and should be considered a part of this specification.

The upper retaining member 265 can include one or more positioning elements 264*a*, 264*b* that can engage corresponding recesses 251*a*, 251*b* in the printed circuit board 250 to hold the printed circuit board 250 in a fixed orientation (e.g., inhibit rotation of the circuit board 250) between the housing 220 and the upper retaining member 265. One or more of the positioning elements 264*a*, 264*b* can, in one embodiment, also extend through corresponding apertures 231*b* formed circumferentially in the body of the optic retainer 230 to thereby attach the optic retainer 230 to the upper retaining member 265 and maintain the optic retainer 230 in a fixed orientation. In another embodiment, apertures 231*b* press-fit on corresponding pegs on the underside of the housing 220. The optic retainer 230 can also have one or more recesses 231*a* sized to slidingly receive a corresponding boss 220*c* in the housing 220 when the optic retainer 230 is coupled to the housing 220, where the optic retainer 230 is maintained in a fixed orientation relative to the housing 220 via the interaction of the recesses 231*a* and bosses 220*c*. In one embodiment, one or more of the positioning elements 264*a*, 264*b* can engage corresponding receivers 220*c* (e.g., bosses) in the housing 220 to couple the upper retaining member 265 to the housing 220, the printed circuit board 250 and optic retainer 230 held in a fixed position therebetween. The housing 220 and upper retaining member 265 can be made of any plastic or resin material such as, for example, polybutylene terephthalate. However, other suitable materials can be used, such as a metal (e.g., a die cast metal).

The upper retaining member 265 can also include one or more planar sections 266, wherein adjacent planar sections 266 define an opening 268 therebetween, the opening 268 sized and shaped to receive a resilient element 263 therethrough when the LED light module 200 is assembled. Additionally, the planar sections 266 define a central opening 267 in the upper retaining member 265, through which the LED 290 can extend.

The printed circuit board 250 can have one or more electrical contact members 252 on a rear side of the printed circuit board 250, so that the contact members 252 face toward the resilient elements 263 of the resilient member 260. The electrical contact member 252 can contact a corresponding electrical contact element 330 (see FIG. 5A) in the socket 300, which can be electrically connected to a power source via one or more cables 323, which can extend through a conduit, such as conduit 410 (see FIG. 12) that extends through the thermally-conductive housing 400. Accordingly, placing the electrical contact members 252 in contact with the electrical contact elements 330 of the socket 300, which can be coupled to a heat sink, such as the heat sink 500, or a thermally-conductive housing, such as the housing 400, allows for power to be provided to the LED light module 200 upon coupling to the socket 300.

The printed circuit board 250 is preferably electrically coupled to the LED 290 and controls or drives the operation of the LED 290. In one embodiment, the LED light module 200 can include a wattage adjust control (e.g., a switch) accessible to a user (e.g., through an opening in the housing of the LED light module) and operatively connected to the LED 290 so that a user can manually adjust the wattage of the LED light module 200 by adjusting the wattage adjust control. In one embodiment, the wattage adjust control can be actuated to vary the wattage of the LED light module 200 between a variety of predetermined wattage set points (e.g., between 6 W, 8 W and 10 W). In one embodiment, the wattage adjust control can be electrically connected to the printed circuit board 250. Further details on wattage adjust control can be found in U.S. application Ser. No. 12/409,409, filed Mar. 23, 2009, incorporated by reference above.

In the illustrated embodiment, the circuit board 250 has two electrical contact members 252, each positioned between two adjacent resilient elements 263. However, in other embodiments, the LED light module 200 can have more electrical contact members 252. In the illustrated embodiment, the electrical contact members 252 are posts disposed 180 degrees apart and that can extend into the socket 300 to contact corresponding electrical contact elements 330 of the socket 300, as further discussed below.

In one embodiment, the electrical contact members 252 can include a hot conductor, a ground conductor and a neutral connection. In one embodiment, ground can be provided by the interaction between the engaging members 223 of the housing 220 and corresponding ramps (see FIG. 4) of the socket 300. For example, at least a portion of one or more of the ramps can be made of metal or have a metal element attached to it that itself is connected to ground. The electrical contact member 252 corresponding to ground is connected to the engaging members 223 via, for example the upper retainer 265 and outer wall 224 of the housing 220. Therefore, when the engaging members 223 contact the metal element of the ramps when the LED light module 200 is coupled to the socket 300, the LED light module 200 is thereby connected to ground. In another embodiment, the electrical contact members 252 can all be disposed on the same side of the circuit board 250 and positioned at radial intervals from an outer edge of the printed circuit board 250 to an inner edge of the printed circuit board 250, with one of the electrical contact members 252 being the hot connector, one being the neutral connector and one being the ground connector. The electrical contact members 252 can pass through separate radially aligned openings (not shown) in the base of the socket, so that each of the electrical contact members 252 contacts a corresponding electrical contact element in the socket 300, one of which can be a hot connector, another a neutral connector, and another a ground connector connected to ground. Accordingly, the LED light module 200 can be grounded as the LED light module 200 is coupled to the socket 300 and the hot, neutral and ground electrical contact members 252 contact corresponding hot, neutral and ground electrical contact elements in the socket 300.

The electrical contact members 252 of the LED light module 200 can advantageously be brought into electrical contact with the electrical contact elements 330 (see FIGS. 5A-5E, 9A-9C) of the socket 300 irrespective of the orientation of the LED light module 200 when coupled to the socket 300, which facilitates the installation of the LED light module 200. This is particularly useful where, for example, the lighting assembly, such as the lighting assembly 10 (see FIG. 12), is high off the ground (e.g., attached to high ceilings) and require great effort to reach to install the LED light module 200. The multiple electrical contact members 252 ensure that the user will correctly install the LED light module 200 on the first try, as opposed to an LED light module 200 where the user may need more than one try to effectively bring the electrical contact member 252 of the LED light module 200 into contact with the corresponding electrical contact element 330 of the socket 300. However, in another embodiment, the LED light module 200 can be used with a lighting assembly where clocking of the LED light module 200 is needed to bring the electrical contact member 252 of the LED light module 200 into contact with the corresponding electrical contact element 330 of the socket 300.

In one embodiment, the one or more electrical contact members 252 can be gold plated to provide effective electrical contact between, for example, the LED light module 200 and the socket 300 of the thermally-conductive housing 400 (see FIG. 12). However, in other embodiments, the one or more electrical contact members 252 can include other suitable electrically conductive materials, such as tin (e.g., via solder tinning).

The thermal interface member 270 can be fixed to the resilient member 260 through one or more fasteners 276, such as screws or other known fasteners, that can be inserted through openings 275 in the thermal interface member 270, extend through openings in tabs 263*c* of the resilient member 260, and engage corresponding bosses 245 in the lower retaining member 240. However, the thermal interface member 270 can be fixed to the resilient member 260 in other suitable manners, such as, with rivets, pins, welds, etc. In one embodiment, the thermal interface member 270 can also be fixed to a thermal pad 280, via which the LED light module 200 can thermally contact, for example, the thermally-conductive housing 400, as discussed further below. In another embodiment, the thermal pad 280 can be omitted, so that the thermal interface member 270 directly contacts the socket or heat sink or thermally conductive housing.

In the illustrated embodiment, the thermal interface member 270 can be a generally planar member with a top surface 271*a* and a bottom surface 271*b*. In one embodiment, the thermal interface member 270 can be disc shaped like a "coin", though in other embodiments the thermal interface member can have other suitable shapes (e.g., oval, square, polygonal). In one embodiment, the thermal interface member 270 can have recessed portions 271*c* formed on the bottom surface 271*b* and aligned with the openings 275. In another embodiment (not shown), the thermal interface member 270 can include an upper portion and a lower portion with a diameter larger than the diameter of upper portion so that the thermal interface member resembles a "top hat", where the LED 290 is attached to a surface of the upper portion. Further details on embodiments of a thermal interface member can be found in U.S. application Ser. No. 12/409,409, filed Mar. 23, 2009, incorporated by reference above.

With continued reference to FIGS. 1A-3B, the thermal pad 280 can be attached to thermal interface member 270 via an adhesive or any other suitable fastener so as to substantially fill microscopic gaps and/or pores between the surface of the thermal interface member 270 and the socket 300 and/or heat sink 500 (see FIG. 9A) or thermally-conductive housing 400 (see FIG. 12) to thereby minimize the thermal impedance between the thermal interface member 270 and the socket 300 and/or heat sink 500 or thermally-conductive housing 400 when the LED light module 200 is coupled to the heat sink 500 or thermally-conductive housing 400 via the socket 300. The thermal pad 280 may be any suitable commercially available or custom formulated thermally conductive pad, such as, for example, Q-PAD 3 Adhesive Back, manufactured by The Bergquist Company. However, as discussed above, in other embodiments the thermal pad 280 can be omitted from the LED light module 200.

With continued reference to FIG. 2A-3B, the thermal interface member 270 can facilitate the positioning of the LED 290 in LED light module 200. In the illustrated embodiment, the LED 290 is directly mounted to, or populated onto, the thermal interface member 270. In one embodiment, a dielectric layer 272 that is thermally conductive and electrically insulating is applied to the top surface 271*a* of the thermal interface member 270. In one embodiment, the dielectric layer 272 is screen printed onto the top surface 271*a* of the thermal interface member 270. An electrical trace layout can then be screen printed on top of the dielectric layer 272. In one embodiment, a solder mask is applied to cover the dielectric layer 272 and trace layout, leaving only the portions of the trace layout exposed to which soldering is desired. Solder pads or terminals are attached to the dielectric layer 272 and are electrically connected to the trace layout, where the solder pads can be electrically connected to the circuit board 250. The LED 290 is populated onto the dielectric layer 272 so that the terminals (e.g., pins, leads) 292 of the LED 290 are electrically connected to the trace layout. The LED 290 can be populated onto the dielectric layer 272 using an automation process, such as an SMT (surface mount technology) method. In another embodiment, the LED 290 can be attached directly to the top surface 271*a* of the thermal interface member 270 without a dielectric layer positioned therebetween. Further details on the direct mounting or populating of the LED 290 onto the thermal interface member 270 can be found in can be found in U.S. application Ser. No. 12/409,409, filed Mar. 23, 2009, incorporated by reference above.

Figure 17A:
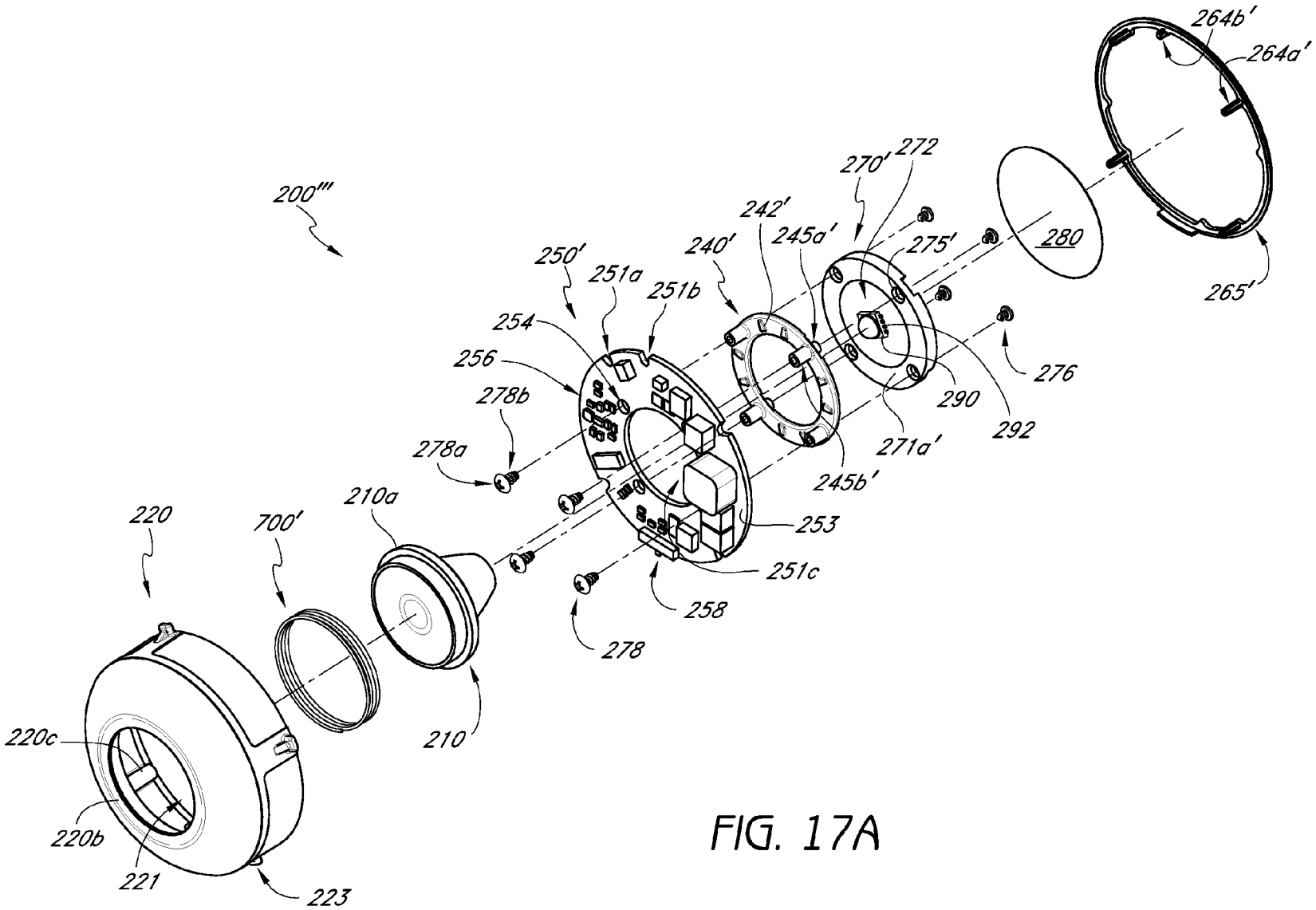
FIG. 17A is a schematic perspective front exploded view of another embodiment of an LED light module.

In another embodiment, the LED 290 can be mounted to the top surface 271*a* of the thermal interface member 270 with fasteners (e.g., screws, bolts, rivets, or other suitable fasteners). Such fasteners can advantageously fasten the LED 290 to the thermal interface member 270 as well as inhibit the rotation of the LED 290 once fixed to the thermal interface member 270. In one embodiment, a thermally conductive material (e.g., as shown in FIG. 17A, below, in connection with thermal interface member 270') can be positioned between LED 290 and the top surface 271*a* of the thermal interface member 270. In another embodiment, the LED 290 is fastened to the surface 271*a* without the use of a thermally conductive material.

In one embodiment, the thermal interface member 270 can be a stamped component, which advantageously facilitates manufacturing (e.g., minimizes machining) and reduces production cost. The top surface 271*a* of the thermal interface member 270 may have minor imperfections, forming voids that may be microscopic in size, but may act as an impedance to thermal conduction between the bottom surface of LED 290 and the top surface 271*a* of thermal interface 270. In one embodiment, a thermally conductive material can be placed between the LED 290 and the top surface 271*a* to facilitate the conduction of heat between the LED 290 and the top surface 271*a* of the thermal interface member 270 by substantially filling these voids to reduce the thermal impedance between LED 290 and the top surface 271*a*, resulting in improved thermal conduction and heat transfer. In one embodiment, the thermally conductive material may be a phase-change material which changes from a solid to a liquid at a predetermined temperature, thereby improving the gap-filling characteristics of the thermally conductive material. For example, thermally conductive material may include a phase-change material such as, for example, Hi-Flow 225UT 003-01, which is designed to change from a solid to a liquid at 55° C. and is manufactured by The Bergquist Company.

In one embodiment, the thermal interface member 270 may be made of aluminum and be disc shaped, as discussed above. However, various other shapes, sizes, and/or materials with suitable thermal conductivity can be used for the thermal interface member 270 to transport and/or spread heat. The LED 290 may be any appropriate commercially available or custom designed single- or multi-chip LED, such as, for example, an OSTAR 6-chip LED manufactured by OSRAM GmbH, having an output of 400-650 lumens.

In the embodiments disclosed above, the LED light module 200 advantageously requires few fasteners to assemble, which advantageously reduces manufacturing cost and time. For example, in the illustrated embodiment, the LED light module 200 can be assembled simply with the use of fasteners 276, such as screws, to fasten the thermal interface member 270 to the bosses 245 of the lower retaining member 240 and the resilient member 260. In another embodiment (not shown), the thermal interface member 270 and resilient member 260 can be fastened together without using screws or similar fasteners. For example, in some embodiments, a press-fit, quick disconnect or clip-on mechanism can be used to fasten the thermal interface member 270 to the resilient member 260. Advantageously, the upper retaining member 265 can be fastened to the housing 220 without the use of separate fasteners, with the optic 210, optic retainer 230, circuit board 250, and resilient member 260 disposed between the upper retaining member 265 and the housing 220.

During use, as shown in FIGS. 3A-3B, the resilient elements 263 flex when the LED light module 200 is moved from an uncompressed position (FIG. 3A) to a compressed position (FIG. 3B), such as when the LED light module is coupled to the socket 300, which is described further below. As shown in FIG. 3A, in the uncompressed position, the optic 210 is spaced apart from the LED 290 and lower retaining member 240, the optic 210 held between the underside surface 220*a* of the shoulder 220*b* of the housing 220 and the shelf 233 of the optic retainer 230. Additionally, an annular projection 220*d* on the underside of the housing 220 helps to maintain the optic 210 in a position aligned with the axis of the housing 220 and LED 290. As the LED light module 200 is moved to the compressed position, the resilient elements 263 flex as the thermal interface member 270 is moved (e.g., via contacting the surface of the socket 300, heat sink 500 or thermally conductive housing 400) upwardly toward the housing 220. Such upward movement of the thermal interface member 270 brings the LED 290 into a recess 212 of the optic 210.

Figure 4:
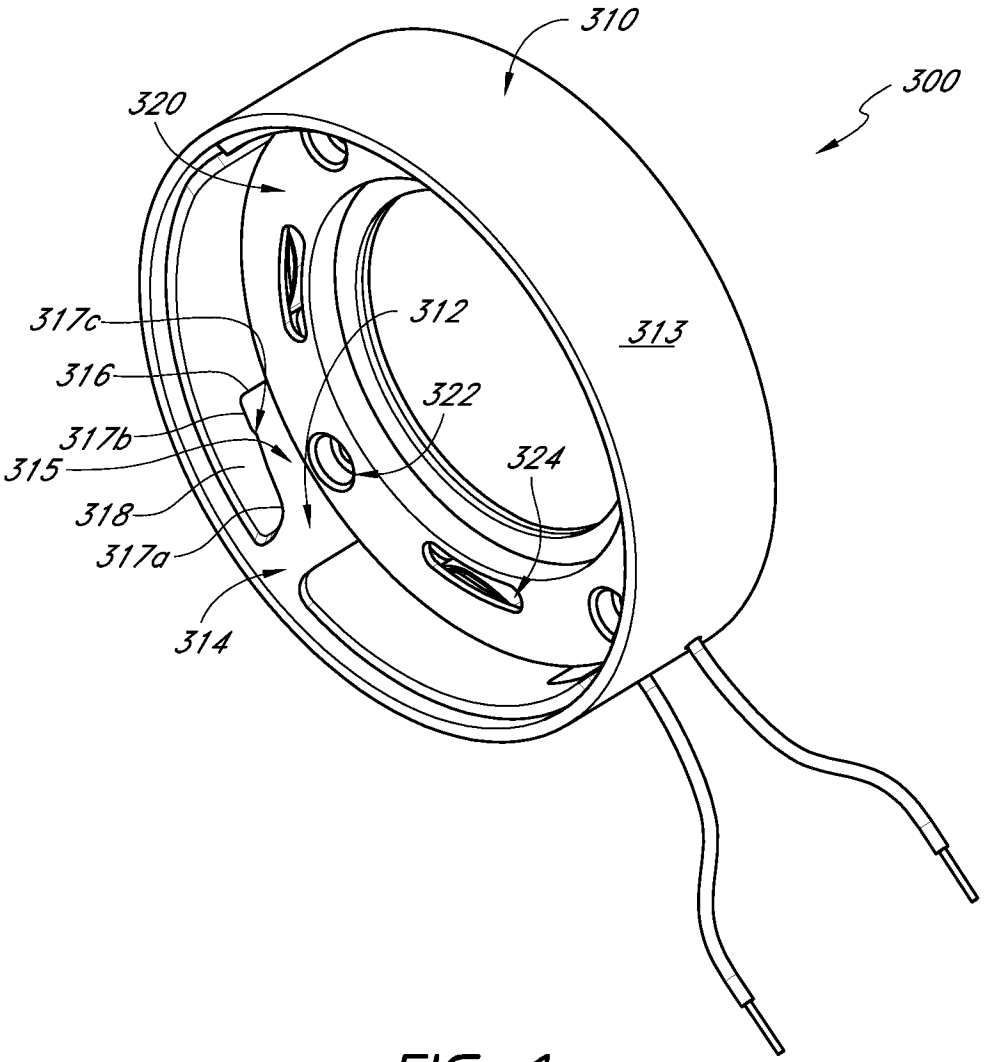
FIG. 4 is a schematic perspective front view of one embodiment of a socket coupleable to an LED light module.
Figure 5A:
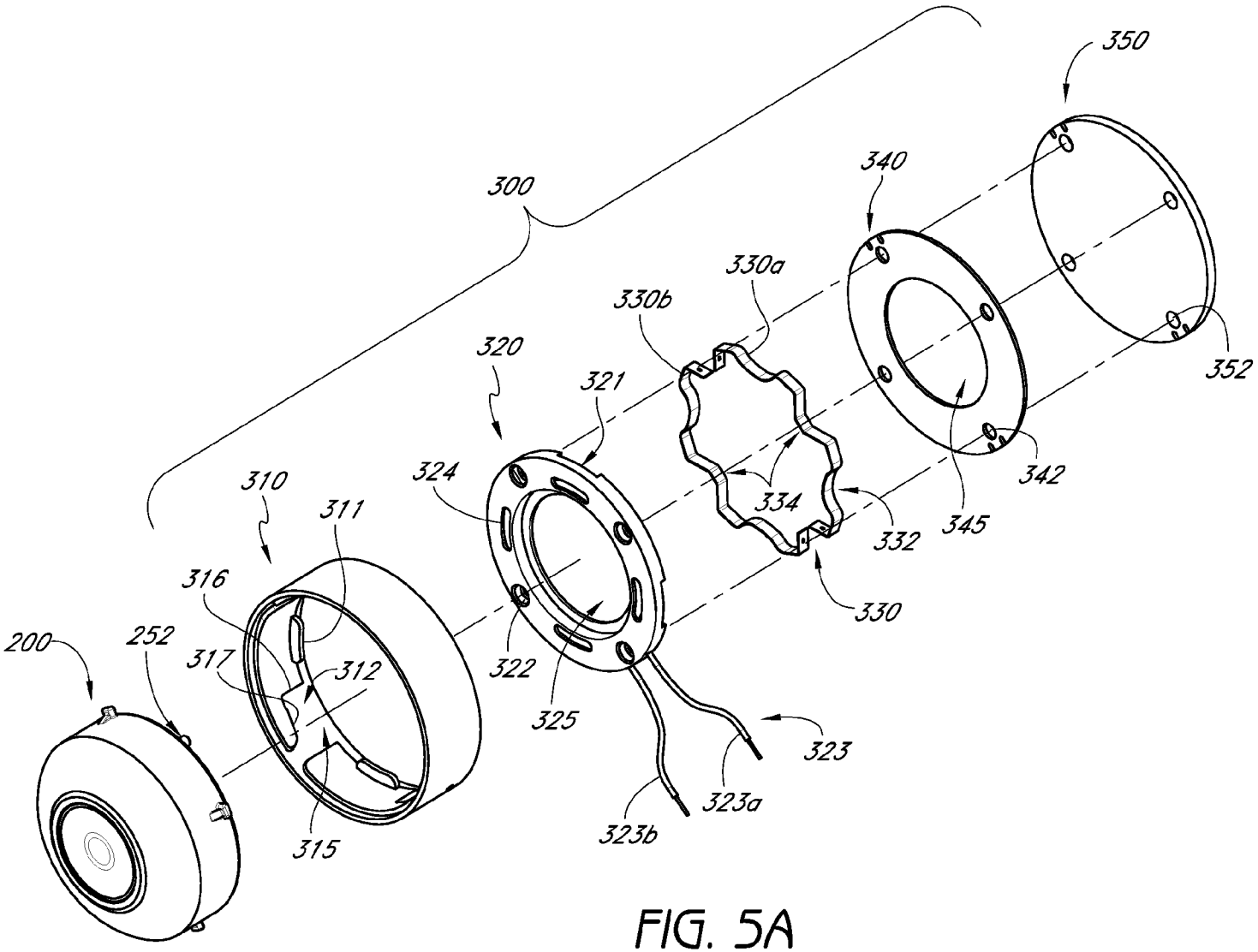
FIG. 5A is a schematic perspective front exploded view of the socket of FIG. 4 aligned with an LED light module.
Figure 5B:
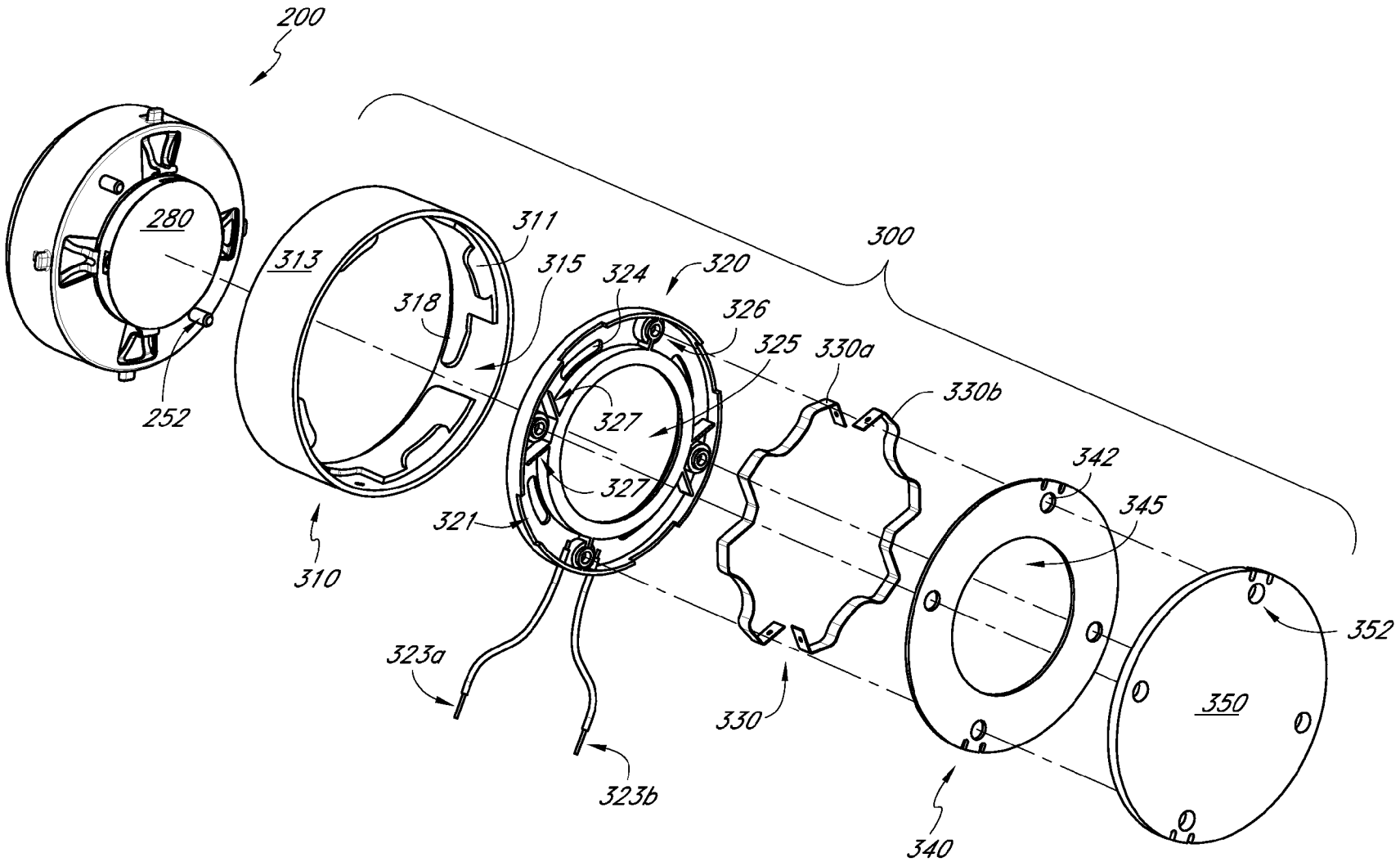
FIG. 5B is a schematic perspective rear exploded view of the socket of FIG. 4 aligned with an LED light module.
Figure 5D:
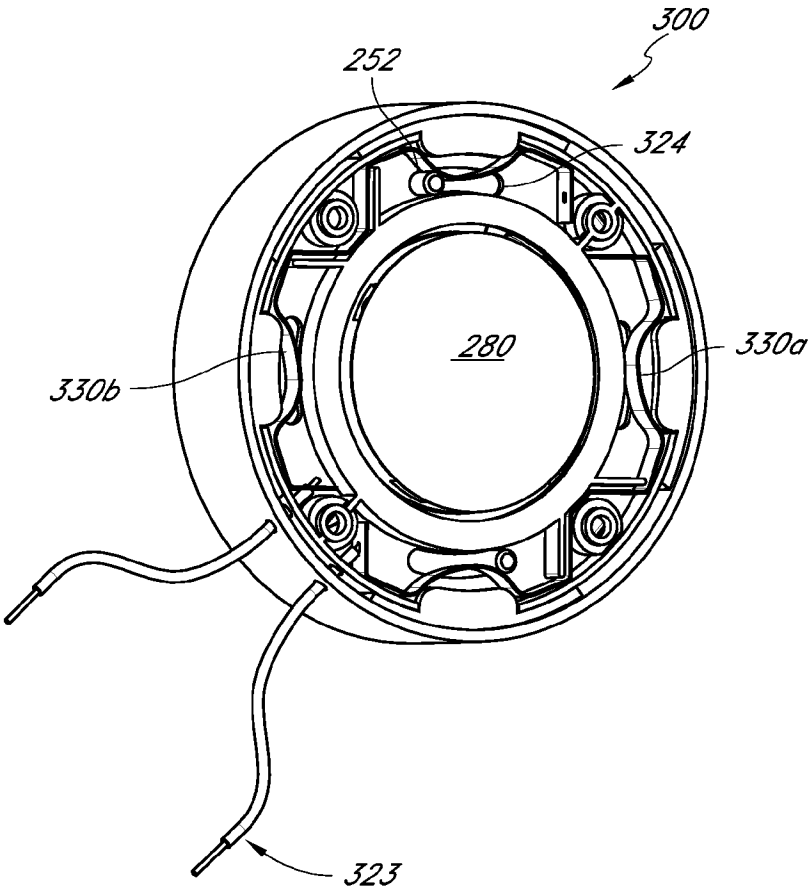
FIG. 5D is a schematic perspective rear view of the partially assembled socket of FIG. 4.
Figure 5C:
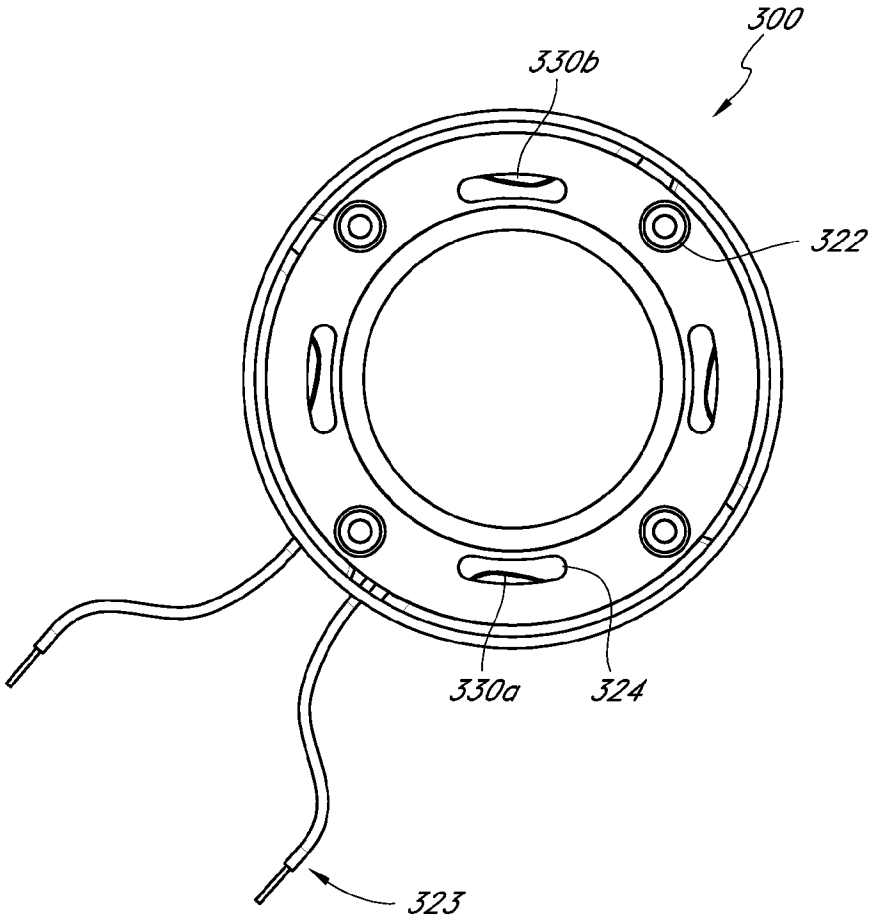
FIG. 5C is a schematic top plan view of the partially assembled socket of FIG. 4.
Figure 5E:
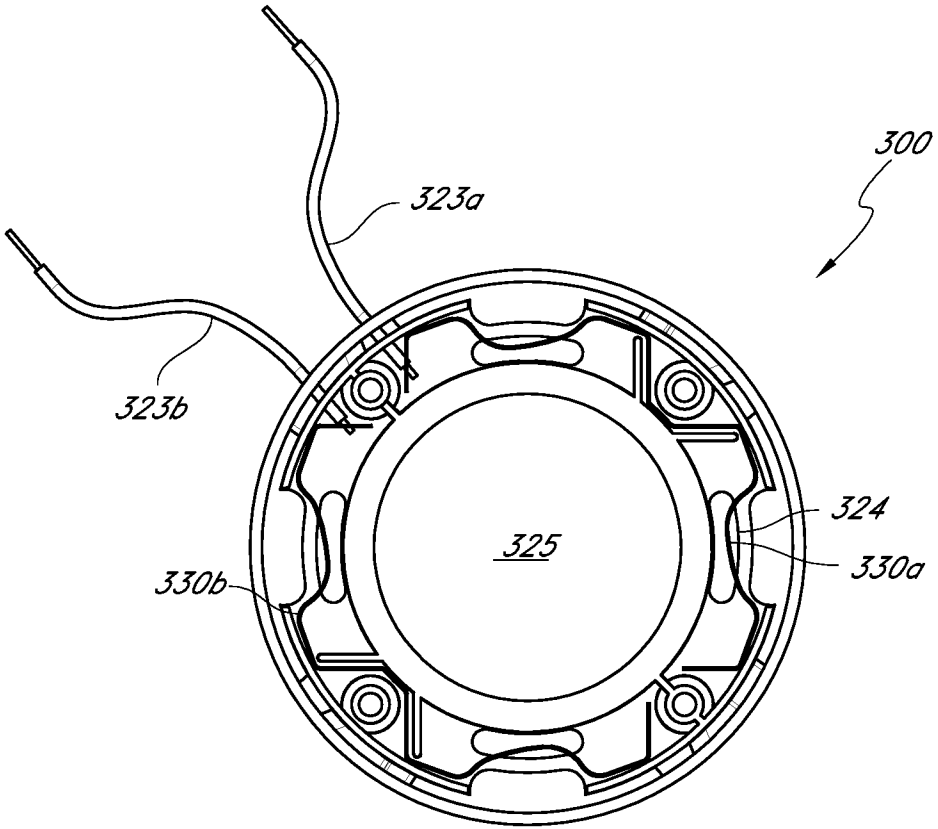
FIG. 5E is a schematic rear plan view of the partially assembled socket of FIG. 4.

With reference to FIGS. 4-5E, the socket 300 to which an LED light module, such as the LED light module 200 illustrated in FIGS. 1A-3B, removably couples can include a compression ring member 310, a socket base 320, one or more electrical contact elements 330, an electrical contact cover 340. In the illustrated embodiment, the socket 300 can optionally include a heat transfer plate 350. In another embodiment, the heat transfer plate 350 can be omitted from the socket 300.

In the illustrated embodiment, the compression ring member 310 can releasably couple to the socket base 320 via one or more coupling members 311 that can engage corresponding coupling elements 321 in the socket base 320. In the illustrated embodiment, the coupling members 311 are tabs and the coupling elements 321 are recesses formed on the socket base 320 that are sized to receive the tabs therein, which advantageously facilitates assembly of the socket 300. The engagement of the coupling members 311 and coupling elements 321 hold the compression ring member 310 and socket base 320 in a fixed orientation relative to each other. In other embodiments, the coupling members 311 and coupling elements 321 can have other suitable shapes (e.g., hooks in the ring member that couple to corresponding shoulders in the socket base). In another embodiment, the compression ring member 310 and socket base 320 do not have coupling members and elements and are instead press-fit to each other. In still another embodiment, the compression ring member 310 and socket base 320 can be a single piece (e.g., molded together).

The socket 300 can releasably lock the LED light module 200 thereto. In the illustrated embodiment, the socket 300 includes one or more recesses or slots 312 in the wall 313 of the socket 300, where the recesses 312 can define a path (e.g., J-shaped, L-shaped, etc.) from an opening 314 at a rim of the socket 300 through a horizontal recess 315 to a stop portion 316. The horizontal recess 315 is defined by an edge 317 of a ramp feature 318, where the edge 317 includes an inclined edge portion 317*a* and recessed edge portion 317*b* that is recessed relative to the inclined edge portion 317*a*. The engaging members 223 of the LED light module 200 can be inserted through the openings 314 and into the slots 312 of the socket 300 to releasably couple the LED light module 200 to the socket 300. For example, the LED light module 200 can be inserted into the socket 300 by aligning the engaging members 223 with openings 314 in the socket and advancing the LED light module 200 until the engaging members 223 are in the recesses 312. The LED light module 200 can then be rotated (see FIG. 9B) so that the engaging members 223 follow the path defined by the opening 314, ramp feature 318 and stop portion 316 to engage an edge defined by the recess 312 of the socket 300, thereby releasably locking the LED light module 200 in place in the socket 300. Specifically, as the LED light module 200 is rotated, the engaging members 223 ride along the inclined edge portion 317*a* of the ramp feature 318 and are captured in the recessed edge portion 317*b*. Once the engaging members 223 pass the inflection point 317*c* of the edge 317, the engaging members 223 abut against the stop portion 316, thereby "locking" the LED light module 200 to the socket 300. In the illustrated embodiment, the LED light module 200 can be rotated in the opposite direction to allow the engaging members 223 to disengage the edge of the recess 312 and allow the LED light module 200 to be removed from the socket 300. Specifically, in one embodiment the LED light module 200 can be pressed toward the socket 300 so that the engaging members 223 clear the recessed edge portion 317*b* and inflection point 317*c*, and the LED light module 200 rotated so that the engaging members 223 ride up the inclined edge portion 317*a* to the opening 314. However, in other embodiments, the LED light module 200 and the socket can be releasably coupled via other suitable mechanisms (e.g., via a threaded connection, a clamped connection, etc.).

In one embodiment, the recesses 312 are preferably dimensioned to cause the resilient elements 263 to compress as the engaging members 223 are moved along the paths defined by the recesses 312, thereby generating a compression force between the thermal interface member 270 and the socket 300 and/or heat sink 500 or thermally-conductive housing 400 to thereby establish a resilient thermal connection between the LED light module 200 and the heat sink 500 or thermally-conductive housing 400.

In one embodiment, as discussed above, the resilient elements 263 can be omitted from the LED light module 200. Instead, the engaging members 223 can be spring loaded so that as the engaging members 223 are moved along the paths defined by the recesses 312, the interaction between the engaging members 223 and the edge 317 of the ramp features 318 generates a compression force between the thermal interface member 270 and the socket 300 and/or heat sink 500 or thermally-conductive housing 400 to thereby establish a resilient thermal connection between the LED light module 200 and the heat sink 500 or thermally-conductive housing 400. In another embodiment, the resilient elements 263 can be omitted from the LED light module 200 and the engaging members 223 not be spring loaded. Rather, the ramp features 318 can be spring loaded so that as the engaging members 223 ride down the edge 317 of the ramp features 318, the ramp features 318 exert a force on the engaging members 223 that generates a compression force between the thermal interface member 270 and the socket 300 and/or heat sink 500 or thermally-conductive housing 400 to thereby establish a resilient thermal connection between the LED light module 200 and the heat sink 500 or thermally-conductive housing 400.

With continued reference to FIGS. 4-5E, the socket base 320 can have one or more bores 322 through which fasteners (e.g. screws) can optionally be inserted. Said fasteners, where used, can also pass through one or more apertures 342 in the electrical contact cover 340 that align with said bores 322 and, where the socket 300 includes the heat transfer plate 350, the fasteners can also extend through one or more apertures 352 in the heat transfer plate 350 that align with said bores 322. In one embodiment, the fasteners can fasten one or more of the heat transfer plate 350 and electrical contact cover 340 to the socket base 320. In the illustrated embodiment, the socket base 320, electrical contact cover 340 and heat transfer plate 350 each have four bores or apertures 322, 342, 352. However, in other embodiments, the socket base 320, electrical contact cover 340 and heat transfer plate 350 can have fewer or more bores or apertures 322, 342, 352.

The socket base 320 can also have one or more slots or openings 324 formed circumferentially around the socket base 320 and sized to receive the electrical contact members 252 (e.g., electrical contact posts) of the LED light module 200. In the illustrated embodiment, the socket base 320 has four slots 324 arranged at intervals of ninety degrees. However, in other embodiments the socket base 320 can have fewer or more slots 324, such as two slots. Advantageously, the slots 324 and the coupling elements 321 are arranged on the socket base 320, and the coupling members 311 arranged on the compression ring member 310 so that insertion of the engaging members 223 of the LED light module 200 through the recesses 312 causes the electrical contact members 252 to extend into the slots 324 and contact the electrical contact elements 330. Additionally, as the engaging members 223 are moved into the locking position against the horizontal recess 315 and stop portion 316, the electrical contact members 252 move along the slots 324 and remain in contact with the electrical contact elements 330. In the illustrated embodiment, the slots 324 are generally kidney-shaped. However, the slots 324 can have other suitable shapes.

In one embodiment, as discussed above, the LED light module 200 can have the electrical contact members 252 positioned on one side of the LED light module assembly 200 and spaced apart at radial intervals relative to each other so that the arrangement of the electrical contact members 252 resemble the prongs of a rake or fork. In such an embodiment, the socket 300 can have the slots 324 on one side of the socket base 320 (as opposed to distributed circumferentially about the socket base 320) and spaced apart at radial intervals so that the arrangement of the slots 324 is similar to the arrangement of the electrical contact members 252. In such an embodiment, all electrical contact members 252 are aligned along a radial plane and the slots 324 are likewise aligned along a radial plane, where the slots 324 receive the electrical contact members 252 as the LED light module 200 is inserted into the socket 300, where the electrical contact members 252 would come in contact with the electrical contact elements 330. In one embodiment as discussed above, one of the electrical contact members 252 can be a hot connector, another can be a neutral connector and another a ground connector. As said, radially aligned electrical contact members 252 are inserted into the radially aligned slots 324, the hot, neutral and ground electrical contact members 252 would come in contact with corresponding hot, neutral and ground electrical contact elements 330.

The socket base 320 also defines an opening 325 therethrough. In the illustrated embodiment, the opening 325 is circular, but can have other suitable shapes. Preferably, the opening 325 can have the same shape as the thermal interface member 270 and can be sized to have a slightly larger diameter than the thermal interface member 270 so as to allow the thermal interface member 270 to extend into the opening 325. In one embodiment, the thermal interface member 270 can extend through the opening 325.

The electrical contact element 330 can include a first contact element 330*a* and a second contact element 330*b* that can be disposed within a rear recess 326 of the socket base 320. Each of the contact elements 330*a*, 330*b* preferably has a contact portion 332 that extends into the view of the slot 324 (see FIGS. 5C, 5E) so that the electrical contact members 252 can come in contact with the contact portion 332 when inserted through the slots 324 (see e.g., FIG. 5D). The electrical contact elements 330*a*, 330*b* also each have a positioning feature 334 that engages a corresponding positioning guide 327 of the socket base 320 to maintain the electrical contact elements 330*a*, 330*b* generally in a rotationally fixed position relative to the socket base 320. The positioning features 334 and corresponding positioning guides 327 inhibit the shifting of the electrical contact elements 330*a*, 330*b* along the circumference of the socket base 320 when the electrical contact members 252 move along the slot 324 while in contact with the first and second electrical contact elements 330*a*, 330*b* (e.g., when the LED light module 200 is rotated so that the engaging members 223 move into the locking position within the horizontal recess 315 and against the stop 316). In the illustrated embodiment, the positioning features 334 are generally V-shaped, and the positioning guides 327 likewise define a generally V-shape. However, in other embodiments, the positioning features 334 and positioning guides 327 can have other suitable shapes that inhibit the shifting of the electrical contact elements 330*a*, 330*b*.

The first and second electrical contact elements 330*a*, 330*b* can be connected to cables 323*a*, 323*b*, respectively, which are connected to a power source (e.g., via conduit 410 of a lighting assembly 10, as discussed above). Preferably, one of the electrical contact elements 330*a* can be a neutral (−) power line and the other of the electrical contact elements 330*b* can be a hot (+) power line. As shown in FIGS. 5D and 5E, the electrical contact elements 330*a*, 330*b* are arranged on opposite halves of the circumference of the socket member 320 so that the contact portion 332 of each electrical contact element 330*a*, 330*b* is accessible via two adjacent slots 324 on said opposite halves of the circumference of the socket member 320. Additionally, in one embodiment each of the electrical contact members 252 or posts can serve as the positive (+) or negative (−) contact for the LED light module 200, so that polarity is not an issue when the LED light module 200 is coupled to the socket 300. Further, as discussed above, the LED light module 200 can advantageously be coupled to the socket 300 irrespective of the orientation of the LED light module 200 and achieve the desired electrical and thermal connection. Additionally, since the electrical contact members 252 (e.g., posts) are preferably oriented 180 degrees apart, and the contact portion 332 of each electrical contact element 330*a*, 330*b* is accessed only via two adjacent slots 324 on opposite halves of the circumference of the socket member 320, insertion of the LED light module 200 into the socket 300 will ensure that only one of the electrical contact members 252 comes in contact with each of the electrical contact elements 330*a*, 330*b*.

With continued reference to FIGS. 5A and 5B, the electrical contact cover 340 can be attached to the socket base 320 so as to cover the recess 326 of the socket base 320 and the electrical contact elements 330*a*, 330*b* disposed within the recess 326. The electrical contact cover 340 can have an opening 345 that preferably has the same size and shape as the opening 325 of the socket base 320. In one embodiment, the electrical contact cover 340 can be made of an electrically insulative material (e.g., plastic). In one embodiment, the heat transfer plate 350 can be attached to the electrical contact cover 340. When thus assembled, the thermal interface member 270 of the LED light module 200 extends into the opening 325 of the socket base 320, into the opening 345 of the electrical contact cover 340 and comes in contact with the heat transfer plate 350. Accordingly, the LED light module 200 can be thermally coupled to the socket 300 via the thermal interface member 270 and heat transfer plate 350. The socket 300 can in turn be coupled to the thermally-conductive housing 400 or other heat sink 500 to place the LED light module 200 in thermal contact therewith via the heat transfer plate 350. The heat transfer plate 350 can in one embodiment be made of aluminum. However, the heat transfer plate 350 can be made of other suitable materials (e.g., other metals).

Figure 8:
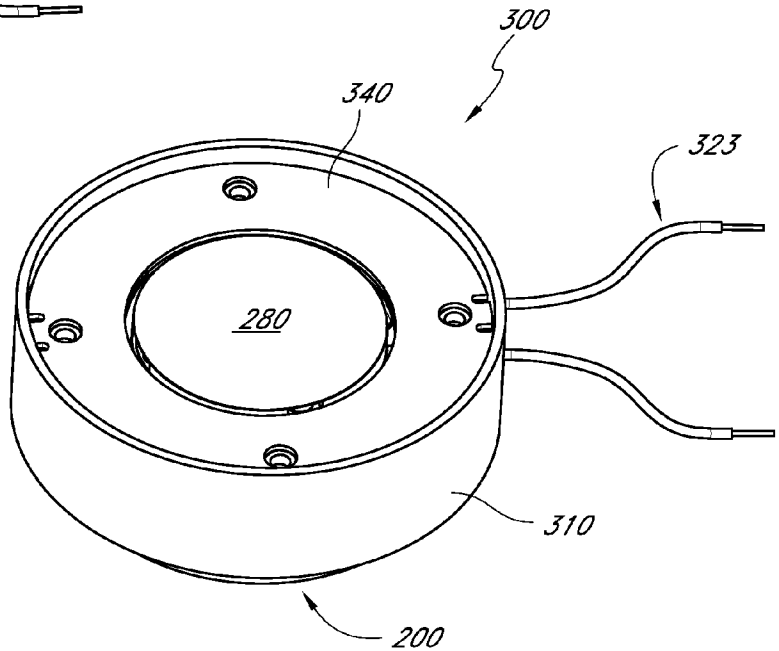
FIG. 8 is a schematic perspective rear view of an LED light module coupled to another embodiment of a socket.

In another embodiment, shown in FIG. 8, the socket 300 does not include a heat transfer plate 350. In this embodiment, the thermal interface member 270 preferably has a thickness that allows it to extend through the openings 325, 345 in the socket base 320 and electrical contact cover 340 to directly contact the heat sink (e.g., interface surface 515 of the heat sink 500 in FIGS. 9A-9B, or corresponding surface on thermally-conductive housing 400 in FIG. 12).

The embodiments of the socket 300 discussed above can be used in embodiments where direct line voltage of 110V is provided to the electrical contact element 330 to power the LED light module 200. Additionally, because the electrical contact element 330 is housed between the socket base 320 and electrical contact cover 340, and because access to the electrical contact elements 330*a*, 330*b* is limited via the slots

324 of the socket base 320, the inadvertent contact with the electrical contact elements 330*a*, 330*b* by a user (e.g., while coupling the LED light module 200 to the socket 300) is prevented. However, the embodiments discussed above are not limited to use with line voltage of 110 V and can be used, for example, in conjunction with a transformer to convert 110V to 24V, where the LED light module 200 operates with 24V.

Figure 6:
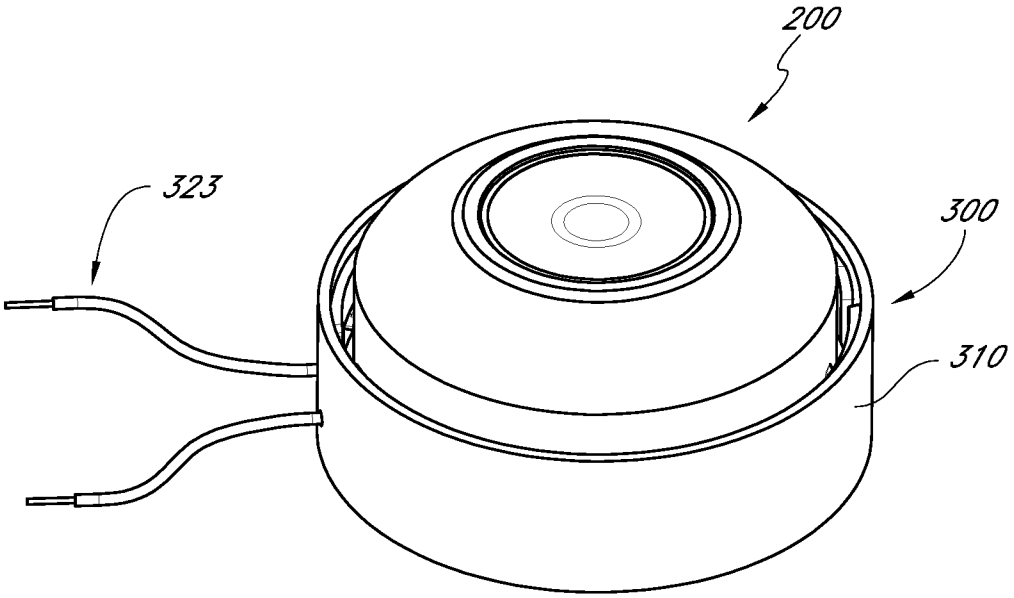
FIG. 6 is a schematic perspective front view of an LED light module coupled to the socket of FIG. 4.
Figure 7:
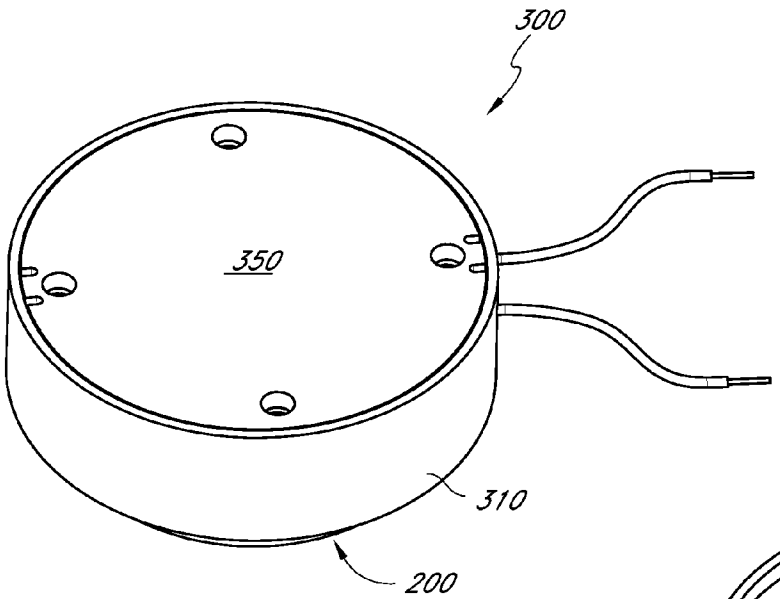
FIG. 7 is a schematic perspective rear view of an LED light module coupled to the socket of FIG. 4.

FIGS. 6, 7 and 8 show the coupling of the LED light module 200 and socket 300. FIG. 6 shows a perspective front view of the LED light module 200 coupled to the socket 300. FIG. 7 shows a perspective bottom view of the LED light module 200 coupled to the socket 300, where the socket 300 includes the heat transfer plate 350. FIG. 8 shows a perspective bottom view of the LED light module 200 coupled to the socket 300, where the socket 300 does not include the heat transfer plate 350 so that the thermal interface member 270 extends through the openings 325, 345 in the socket base 320 and electrical contact cover 340.

FIGS. 9A-10B show the LED light module 200 and socket 300 coupled to a heat sink 500. The heat sink 500 can have one or more bores 510 for fastening the socket 300 thereto. For example, one or more fasteners 360 (e.g., screws, bolts) can be inserted through the bores 322 in the socket base 320, extend through corresponding bores in the electrical contact cover 340 and, optionally, the heat transfer plate 350 (see FIGS. 5A and 5B), and extend into the bores 510, so that the heat transfer plate 350 is in contact with a surface 515 of the heat sink 500 and the socket 300 is fastened to the heat sink 500. The LED light module 200 can then be coupled to the socket 300 as discussed above to thermally couple the LED light module 200 to the heat sink 500 via the thermal interface member 270 and the heat transfer plate 350.

In another embodiment, as discussed above and shown in FIG. 9B, the socket 300 does not include a heat transfer plate 350, and the thermal interface member 270 extends through the openings 325, 345 in the socket 300 to directly contact the surface 515 of the heat sink 500. The heat sink 500 can have one or more fins 520 to dissipate heat from the LED 290 that is conducted to the heat sink 500 via the thermal interface member 270. In other embodiments, the socket 300 can be fastened to the heat sink 500 via other suitable mechanisms, such as adhesives (e.g., thermal paste), welds, other mechanical fasteners (e.g., snap tabs, hooks), etc. With continued reference to FIG. 9B, and as discussed above, the LED light module 200 can be coupled to the socket 300 by first axially advancing the LED light module 200 into the socket 300 as shown by arrow A, and then rotating the LED light module 200 as shown by arrow B once the engaging members 223 are disposed in the recesses 315. As the LED 290 is coupled to the thermal interface member 270, which is coupled to the housing 220 via the resilient member 260, lower retaining member 240 and upper retaining member 265. Therefore, the LED 290 is rotationally fixed relative to the housing 220 so that the LED 290 rotates along with the housing 220 as the LED light module 200 is rotated.

Figure 9C:
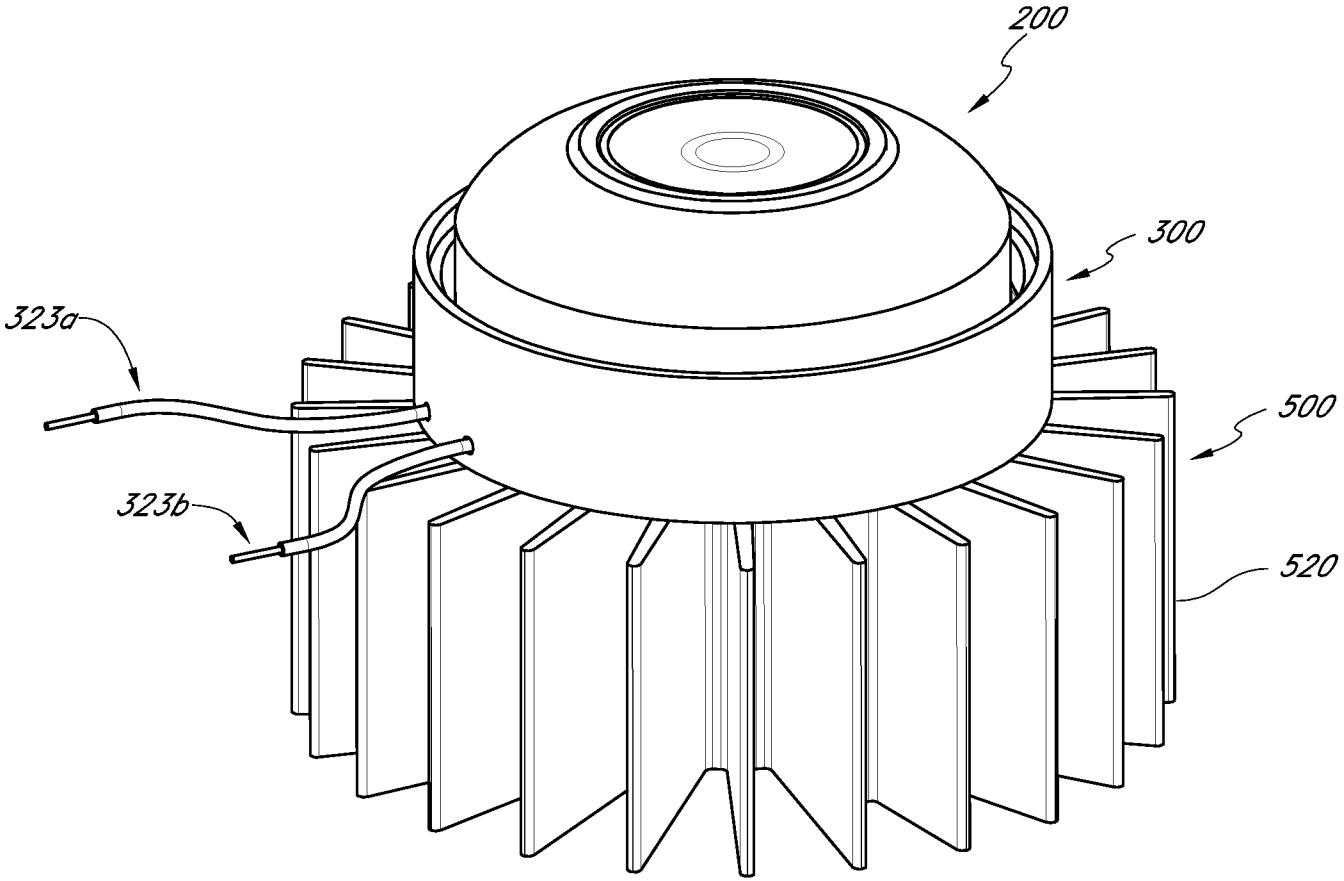
FIG. 9C is a schematic perspective top view of the assembled LED light module, socket and heat sink of FIG. 9B.
Figure 10A:
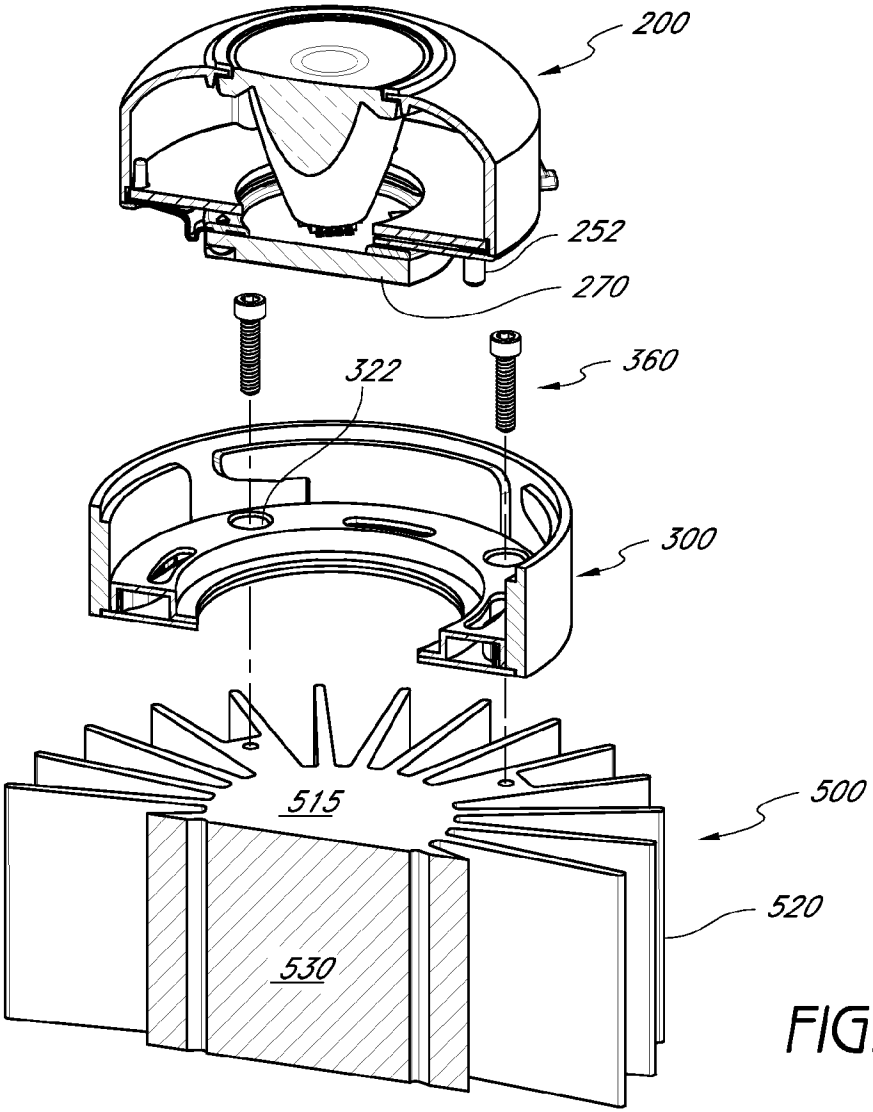
FIG. 10A is a schematic perspective exploded cross-sectional view of the LED light module, socket and heat sink of FIG. 9A.
Figure 10B:
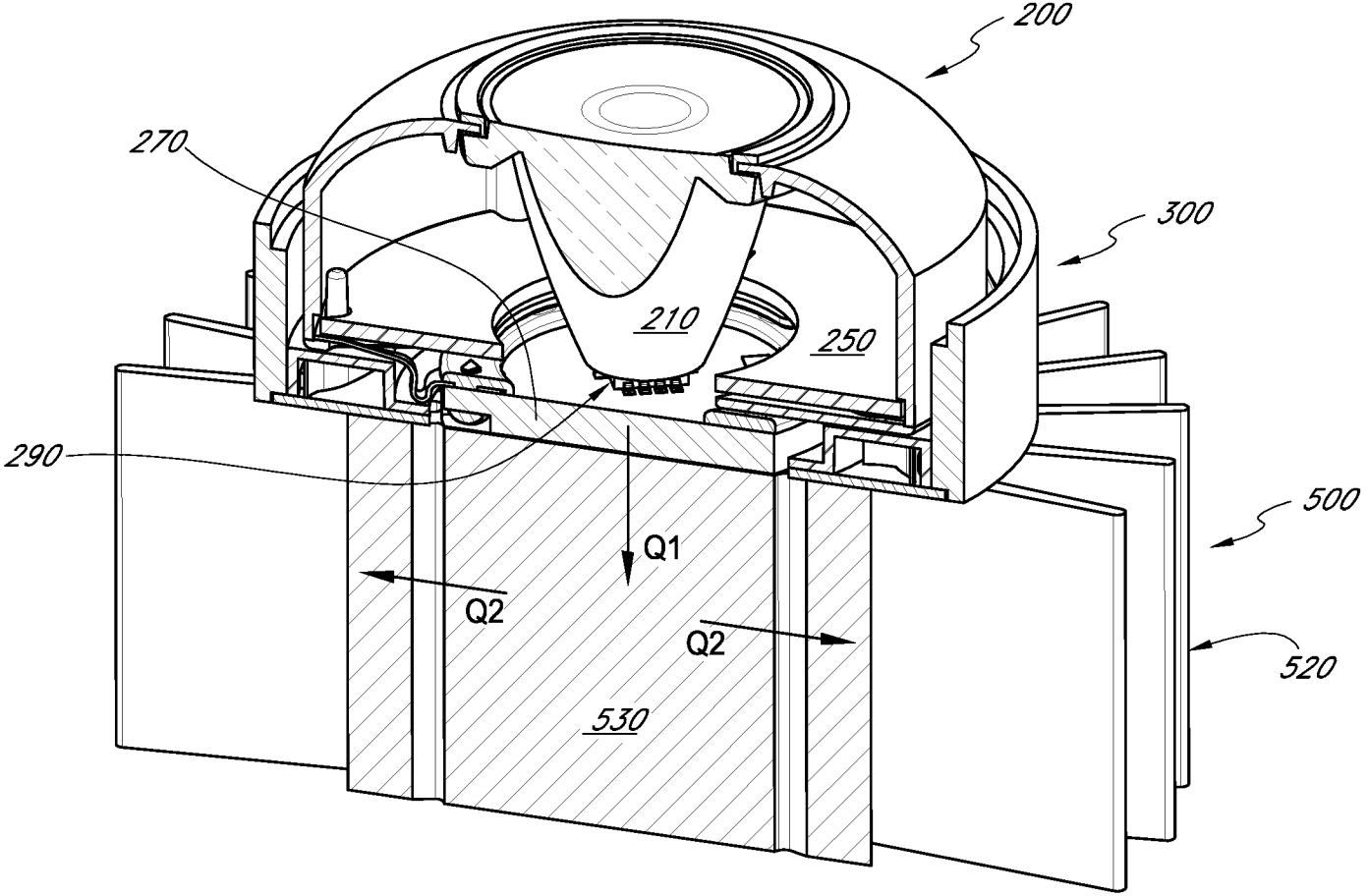
FIG. 10B is a schematic perspective cross-sectional view of the LED light module, socket and heat sink of FIG. 9A in an assembled state.

FIG. 9C shows the LED light module 200, socket 300 and heat dissipating member or heat sink 500 in an assembled state. FIGS. 10A-B show a cross-sectional view of the LED light module 200, socket 300 and heat sink 500 in an exploded view and an assembled view, respectively. In the illustrated embodiment, the socket 300 does not have the heat transfer plate 350 and the thermal interface member 270 extends through openings 325, 345 in the socket base 320 and electrical contact cover 340, respectively, to directly contact the surface 515 of the heat sink 500. As shown in FIG. 10B, the contact between the thermal interface member 270 and the surface 515 of the heat sink 500 allows heat generated by the LED 290 during operation to be transferred to the heat sink 500 via conduction via paths Q1 from the thermal interface member 270 to a core 530 of the heat sink 500, and via paths Q2 from the core 530 of the heat sink 500 to the one or more fins 520 of the heat sink 500. In another embodiment, the heat transfer path can be across an air gap between a surface of the thermal interface member 270 and a surface of the socket 300 or heat sink 500 and the heat transfer mechanism can be conduction across said air gap, convection across said air gap, and/or radiation across said air gap.

Though the illustrated embodiment shows the LED light module 200 and socket 300 coupled to the heat sink 500, the LED light module 200 and socket 300 can be coupled to any type of cooling mechanism or heat removing mechanism, such as a refrigeration system, a water cooling system, air cooling system, etc.

Figure 11:
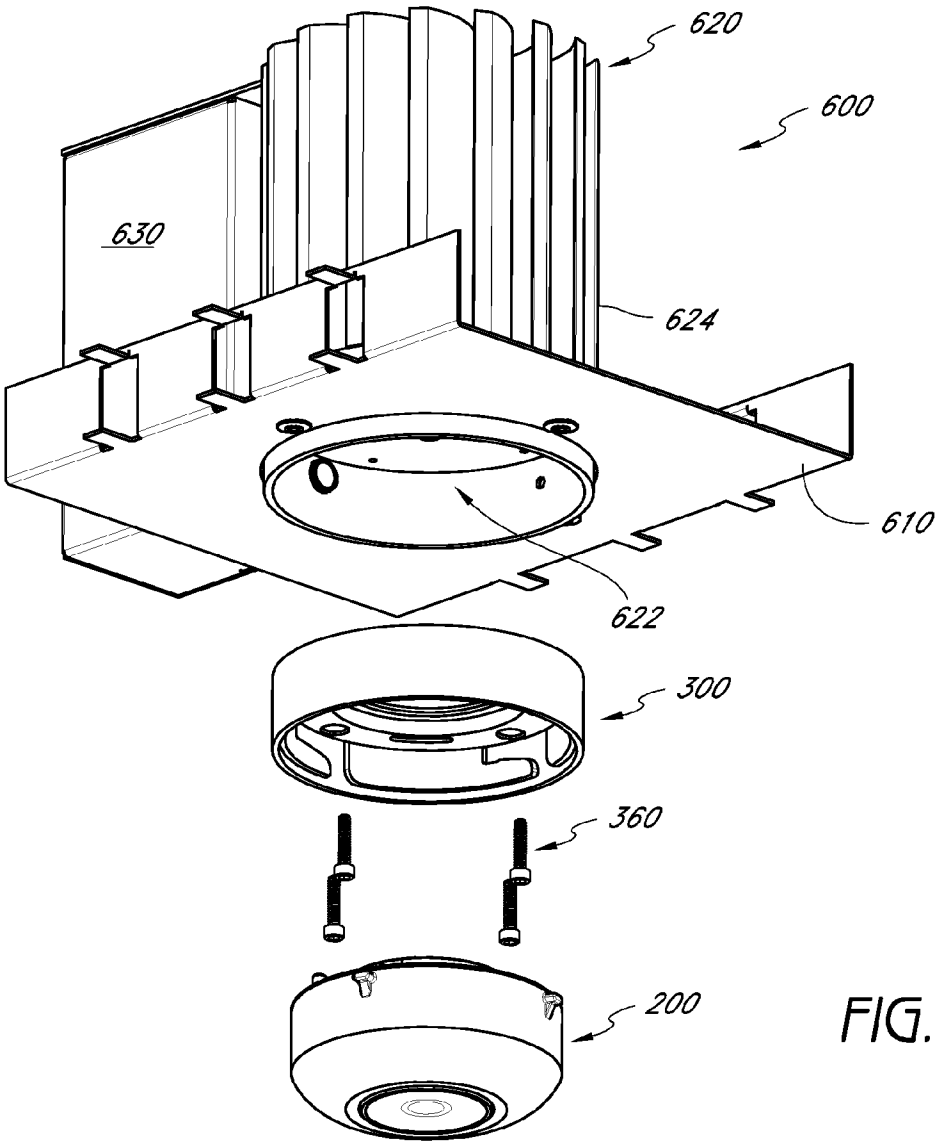
FIG. 11 is a schematic perspective exploded bottom view of an LED light module, socket and recessed lighting assembly.

FIG. 11 shows one embodiment of a recessed lighting assembly 600 with which the LED light module 200 can be used. The lighting assembly 600 can include a mounting plate 610 and a thermally-conductive housing 620 with a recessed opening 622 that can receive the socket 300 therein. In another embodiment, the socket 300 can be integrally formed with the thermally conductive housing 620. The LED light module 200 can thus be coupled to the housing 620 via the socket 300 and the housing 620 can serve as a heat sink to conduct heat away from the LED light module 200. Additionally, the housing 620 can have one or more fins 624 for dissipating heat to the ambient environment via natural convection. The lighting assembly 600 can also have a transformer 630, which can be an off-the-shelf or custom-made transformer (e.g., 110V AC to 24V AC transformer), electrically connected to the socket 300.

The lighting assembly 600 can in one embodiment also have a front cover (e.g., trim ring) coupleable with the socket 300, the front cover having an opening that allows light generated by the LED 290 to pass therethrough.

The lighting assembly 600 can be used to provide a recessed lighting arrangement in a home or business, where the socket 300 can be on one side of the mounting surface (e.g., wall) and the mounting plate 610, housing 620 and transformer 630 can be out of sight on an opposite side of the mounting surface. Accordingly, a user can readily install and replace the LED light module 200 and, optionally, cover the socket 300 with a front cover. In a preferred embodiment, the front cover couples to the socket 300 so that no portion of the LED light module 200 is exposed.

FIG. 12 is an exploded perspective view of one embodiment of a lighting assembly 10 with which the LED light module 200 can be used. The lighting assembly 10 can include a front cover 100, the LED light module 200, the socket 300 and the thermally-conductive housing 400 to which the socket 300, in one embodiment, can be coupled. The lighting assembly 10 can have a conduit 410 that extends through the thermally-conductive housing 400 and through which the cables 323 that connect with the electrical contact elements 330*a*, 330*b* can extend. The conduit 410 can have a proximal end 414 that can be coupled to a power source (e.g., commercial power source). In the illustrated embodiment, the lighting assembly 10 is a track lighting assembly. However, in other embodiments, the LED light module 200 can be coupled to other types of lighting assemblies 10, such as recessed lighting assemblies, outdoor lighting assemblies (e.g., street lights), lights for vehicles (e.g., bicycles, motorcycles, automobiles, boats, airplanes), flashlights or portable lighting. In one embodiment, the socket 300 does not include the heat transfer plate 350 so that the thermal interface member 270 extends through the socket base 320 and contacts the corresponding interface surface 415 of the thermally conductive housing 400.

After the LED light module 200 is installed in the thermally-conductive housing 400, a front cover 100 may be attached to socket 300 by engaging front cover engaging member 101 on the front cover 100 with front cover retaining mechanism on the socket 300 (not shown). Rotating the front cover 100 with respect to socket 300 secures the front cover engaging member 101 with a front cover retaining mechanism (e.g., slot) to lock the front cover 100 in place. The front cover 100 may include a main aperture 102 formed in a center portion of cover 100, a transparent member, such as a lens 104 placed within aperture 102, and one or more peripheral holes 106 formed on a periphery of front cover 100 that allow air to pass therethrough. The lens 104 allows light emitted from a lighting element (e.g., LED 290) to pass through the cover 100, while also protecting the lighting element from the environment. The lens 104 may be made from any appropriate transparent or translucent material to allow light to flow therethrough, with minimal reflection or scattering. However, in other embodiments, other suitable mechanisms can be used to attach the front cover 100 to the thermally-conductive housing 400, such as a press-fit connection.

The front cover 100, LED light module 200, socket 300, and thermally-conductive housing 400 may be formed from materials having a thermal conductivity k of at least 12 W/mK, and preferably at least 200 W/mK, such as, for example, aluminum, copper, or thermally conductive plastic. However, other suitable materials can be used. The front cover 100, LED light module 200, socket 300, and thermally-conductive housing 400 may be formed from the same material, or from different materials. The one or more peripheral holes 106 may be formed on the periphery of front cover 100 such that they are equally spaced and expose portions along an entire periphery of the front cover 100. Although a plurality of peripheral holes 106 are shown in the illustrated embodiment, one or more peripheral holes 106 or none at all can be used in other embodiments. The peripheral holes 106 can advantageously allow air to flow through front cover 100, into and around the LED light module 200 and flow through air holes in the thermally-conductive housing 400 to dissipate heat generated by the LED 290.

In one embodiment, the one or more peripheral holes 106 may be used to allow light emitted from LED 290 to pass through peripheral holes 106 to provide a corona lighting effect on front cover 100. In another embodiment, the thermally-conductive housing 400 may be made from an extrusion process, where at least a portion of the thermally-conductive housing 400 is a heat sink that includes a plurality of surface-area increasing members, such as fins 402 or ridges. Further details on the thermally conductive housing 400 and lighting assemblies 10 with which the LED light module 200 can be used are provided in U.S. patent application Ser. Nos. 11/715,071 and 12/149,900, the entire contents of both of which are hereby incorporated by reference in their entirety and should be considered a part of this specification.

The fins 402 may serve multiple purposes. For example, fins 402 may provide heat-dissipating surfaces so as to increase the overall surface area of the thermally-conductive housing 400, thereby providing a greater surface area for heat to dissipate to an ambient atmosphere. That is, the fins 402 may allow the thermally-conductive housing 400 to act as an effective heat sink for the lighting assembly 10. Moreover, the fins 402 may also be formed into any of a variety of shapes and formations such that thermally-conductive housing 400 takes on an aesthetic quality. That is, the fins 402 may be formed such that thermally-conductive housing 400 is shaped into an ornamental extrusion having aesthetic appeal. However, the thermally-conductive housing 400 may be formed into a plurality of other shapes, and thus function not only as a ornamental feature of the lighting assembly 10, but also as a heat sink to dissipate heat from the LED 290.

FIGS. 13A-14B show another embodiment of an LED light module 200'. The LED light module 200' is similar to the LED light module 200, except as noted below. Thus, the reference numerals used to designate the various components of the LED light module 200' are identical to those used for identifying the corresponding components of the LED light module 200 in FIGS. 1A-3B.

Figure 14B:
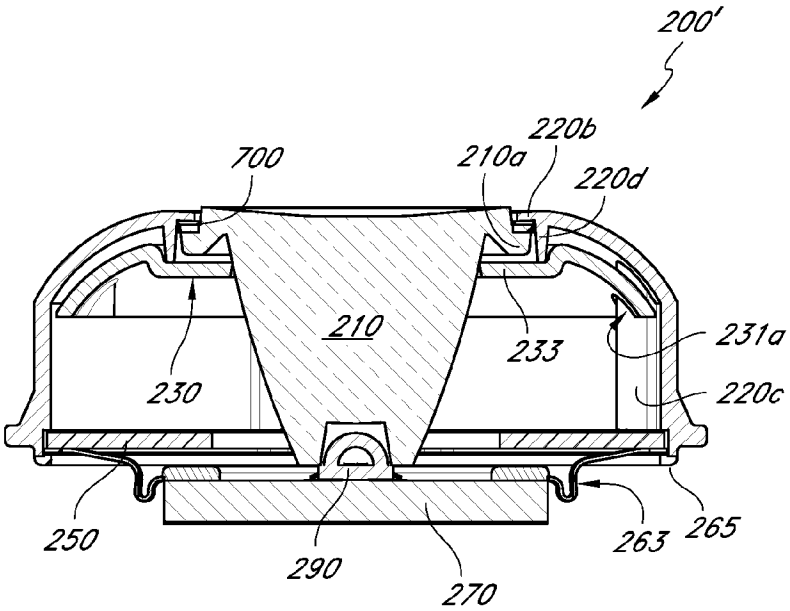
FIG. 14B is a schematic cross-sectional side view of the LED light module of FIG. 13A in a compressed position.
Figure 14A:
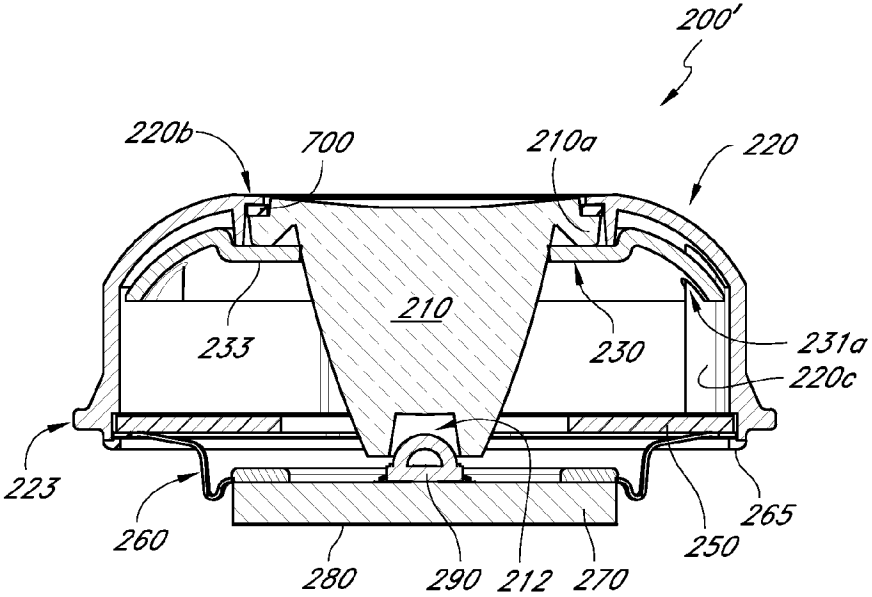
FIG. 14A is a schematic cross-sectional side view of the LED light module of FIG. 13A in an uncompressed position.
Figure 15A:
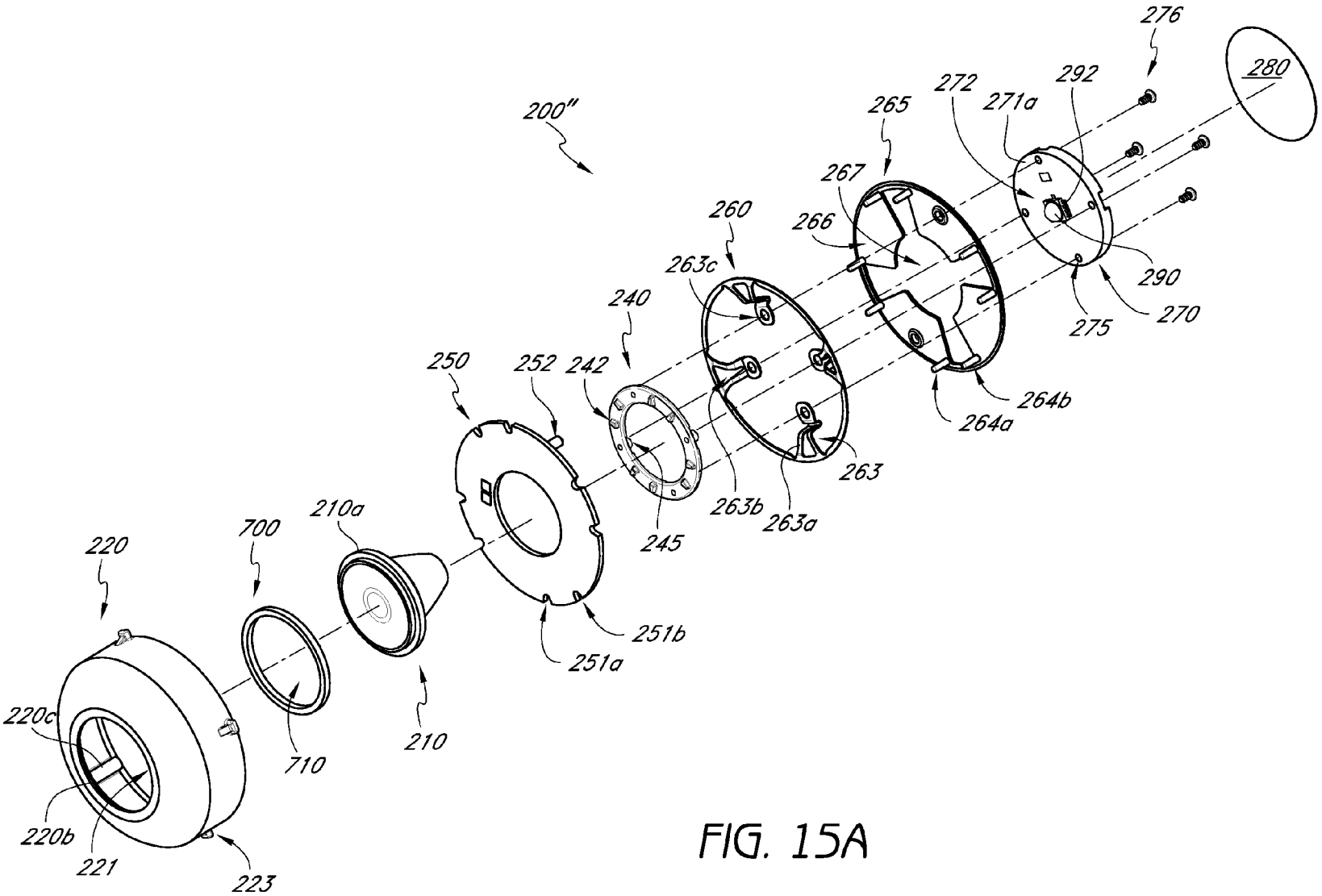
FIG. 15A is a schematic perspective front exploded view of another embodiment of an LED light module.
Figure 15B:
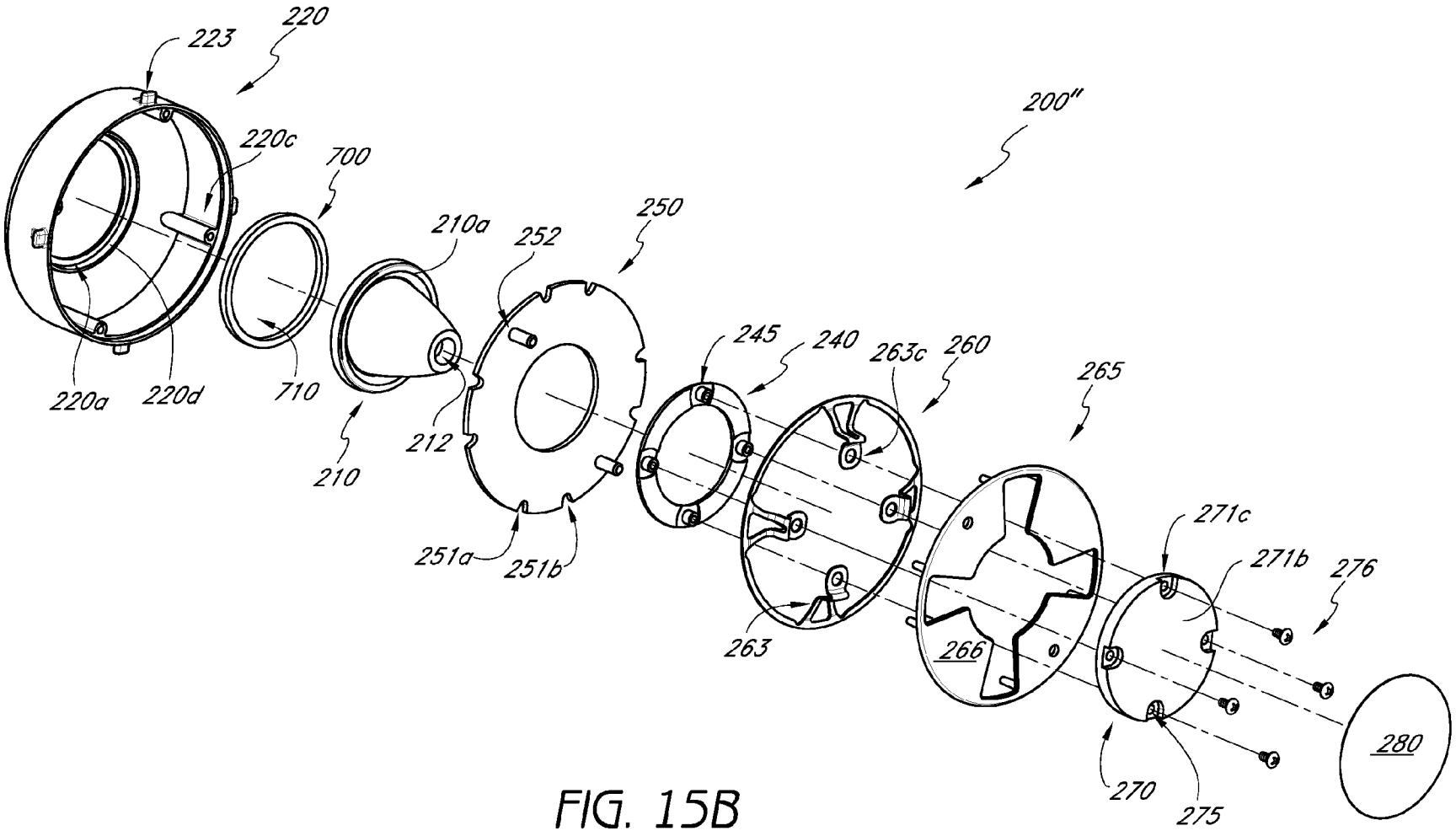
FIG. 15B is a schematic perspective rear exploded view of the LED light module of FIG. 15A.

In the illustrated embodiment, a resilient member 700 is positioned between the shoulder 210*a* of the optic 210 and the shoulder 220*b* of the housing 220, so that the resilient member 700 contacts the shoulder 210*a* and the underside surface 220*a* of the shoulder 220*b*, as shown in FIG. 14A. In the illustrated embodiment, the resilient member 700 is an annular ring-shaped member with an opening 710 therethrough. However, in other embodiments, the resilient member 700 can have other suitable shapes. Preferably, the shape of the resilient member 700 corresponds to the shape of the annulus defined by the annular projection 220*d* on the underside of the housing 220 so that the resilient member 700 can contact the underside surface 220*a*.

In one embodiment, the resilient member 700 is ring-shaped gasket made of PORON® microcellular polyurethane. Such material is manufactured, for example, by Rogers Corporation of Rogers, Conn. However, in another embodiment the resilient member 700 can be made of any other microcellular polyurethane material. In still another embodiment, the resilient member 700 can be made of any other suitable material, such as rubber, foam, or other compressible material that is resilient and substantially returns to its uncompressed shape when a compression force is removed. In still another embodiment, the resilient member 700 can be a spring, such as a leaf spring (e.g., stamped leaf spring), or compression spring (e.g., helical spring, wave washer). In one embodiment, the resilient member 700 can be made of a compressible rubber-like material, as discussed above. In another embodiment, the resilient member 700 can be made of metal (e.g., metal spring).

With reference to FIGS. 14A-14B, as the resilient member 700 advantageously compresses as the LED light module 200' is moved from the uncompressed position (FIG. 14A) to the compressed position (FIG. 14B), for example by the coupling of the LED light module 200' to the socket 300. Compression of the resilient member 700 allows the member 700 to cushion the advancement of the optic 210 toward the shoulder 220*b* of the housing 220 once the distal end of the optic 210 contacts the LED 290 and moves along with the LED 290 and thermal interface member 270 toward the front of the housing 220, which causes the shoulder 210*a* of the optic 210 to lift away from the shelf 233 of the optic retainer 230. This inhibits damage to the LED light module 200', including the optic 210 and LED 290 during coupling of the LED light module 200' to the socket 300. Additionally, said cushioning provided by the resilient member 700 allows for broader tolerances in the manufacturing of the LED light module 200' while achieving the desired thermal coupling between the LED light module 200' and the socket 300 and/or heat sink 500 or thermally conductive housing 400. Further, in the compressed position (e.g., FIG. 14B), the resilient member 700 generates a compression force that urges the thermal interface member 270, via the contact with the optic 210 and LED 290 therebetween, toward the socket 300 and/or heat sink 500 or thermally conductive housing 400. Accordingly the resilient member 700 can generate a compression force on top of the compression force generated by the resilient members 263 to achieve a thermal coupling between the LED light module 200' and the socket 300 and/or heat sink 500 or thermally conductive housing 400. In another embodiment, said compression force for achieving the thermal coupling between the LED light module 200' and the socket 300 and/or heat sink 500 or thermally conductive housing 400 can be provided solely by the resilient member 700, and the resilient members 263 can be omitted from the LED light module 200'.

FIGS. 15A-16B show another embodiment of an LED light module 200". The LED light module 200" is similar to the LED light module 200', except as noted below. Thus, the reference numerals used to designate the various components of the LED light module 200" are identical to those used for identifying the corresponding components of the LED light module 200' in FIGS. 13A-14B.

Figure 16B:
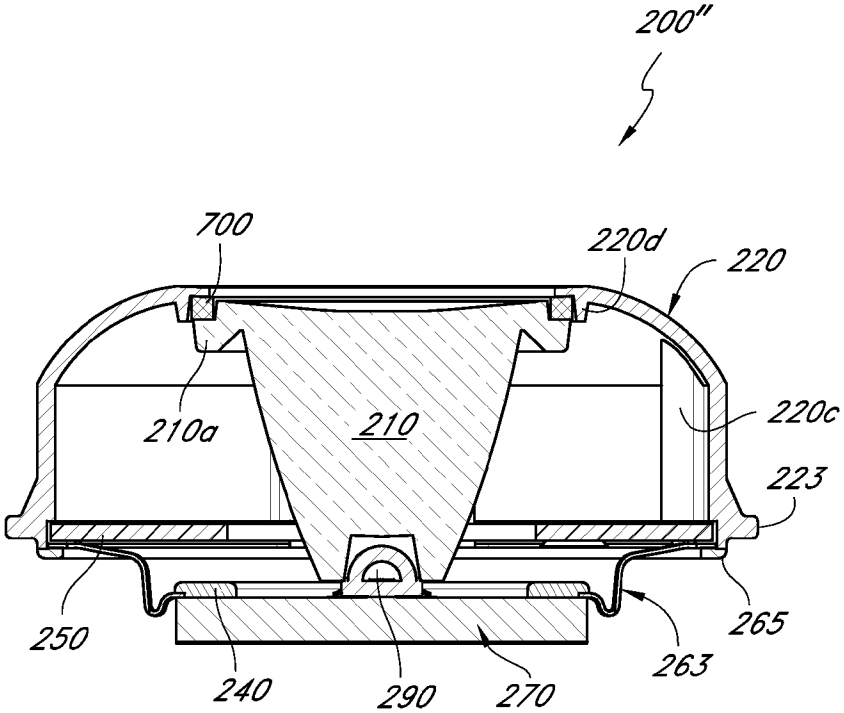
FIG. 16B is a schematic cross-sectional side view of the LED light module of FIG. 15A in a compressed position.
Figure 16A:
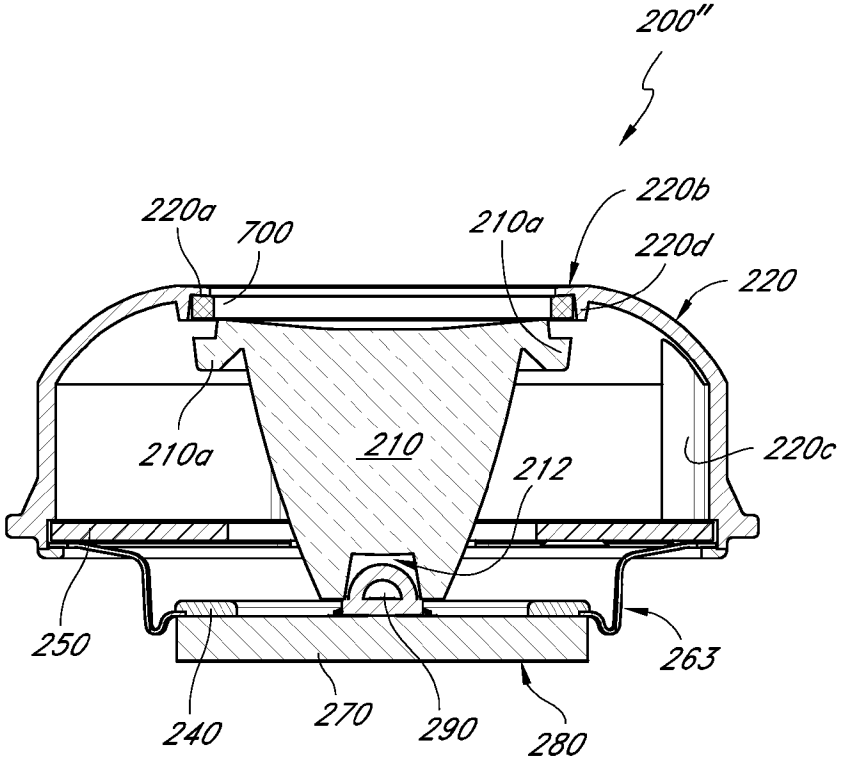
FIG. 16A is a schematic cross-sectional side view of the LED light module of FIG. 15A in an uncompressed position.

In the illustrated embodiment, the LED light module 200" does not have an optic retainer, such as the optic retainer 230 in the LED light module 200'. As best shown in FIG. 16A, the resilient member 700 is attached to the underside surface 220*a* of the shoulder 220*b* of the housing 220, and circumscribed by the annular projection 220*d*. In one embodiment, the resilient member 700 is adhered to the underside surface 220*a*. However, other suitable mechanisms can be used to attach the resilient member 700 to the underside surface 220*a*. The underside surface 220*a* and annular projection 220*d* therefore help to maintain the resilient member 700 aligned with the optic 210. As shown in FIG. 16A, the optic 210 is attached to the LED 290 and thermal interface member 270, so that the optic 210, LED 290 and thermal interface member 270 move as one piece. In the uncompressed position, the shoulder 210*a* of the optic 210 is axially spaced apart from the resilient member 700 so that the optic 210 and resilient member 700 are not in contact.

As the LED light module 200" is moved from the uncompressed position (FIG. 16A) to the compressed position (FIG. 16B), the thermal interface member 270, LED 290 and optic 210 move axially together toward the resilient member 700. During said movement, the shoulder 210*a* of the optic 210 contacts the resilient member 700 and further movement of the thermal interface member 270, LED 290 and optic 210 compresses the resilient member 700 between the shoulder 210*a* and the underside surface 220*a*.

In another embodiment (not shown), the resilient member 700 can be attached to the shoulder 210*a* of the optic 210, so that the resilient member 700 and optic 210 move as one piece along with the LED 290 and thermal interface member 270 as the LED light module 200" moves from the uncompressed position to the compressed position. In this embodiment, the resilient member 700 is spaced apart from the underside surface 220*a* of the housing 220 when the LED light module 200" is in the uncompressed position, and moves into contact with the underside surface 220*a* as the LED light module 200" moves into the compressed position. Following said contact, the resilient member 700 compresses between the optic shoulder 210*a* and the underside surface 220*a* of the housing 220 as the thermal interface member 270, LED 290 and optic 210 continue to move toward the shoulder 220*b* at the front of the housing 220.

As discussed above in connection with FIGS. 13A-14B, the resilient member 700 can be made of a variety of materials and advantageously inhibits damage to the LED light module 200" during coupling with the socket 300 and/or heat sink 500 or thermally conductive housing 400, as well as allows for broader manufacturing tolerances for the LED light module 200".

FIGS. 17A-18B show another embodiment of an LED light module 200'''. The LED light module 200''' is similar to the LED light module 200", except as noted below. Thus, the reference numerals used to designate the various components of the LED light module 200''' are identical to those used for identifying the corresponding components of the LED light module 200" in FIGS. 15A-16B.

Figure 18B:
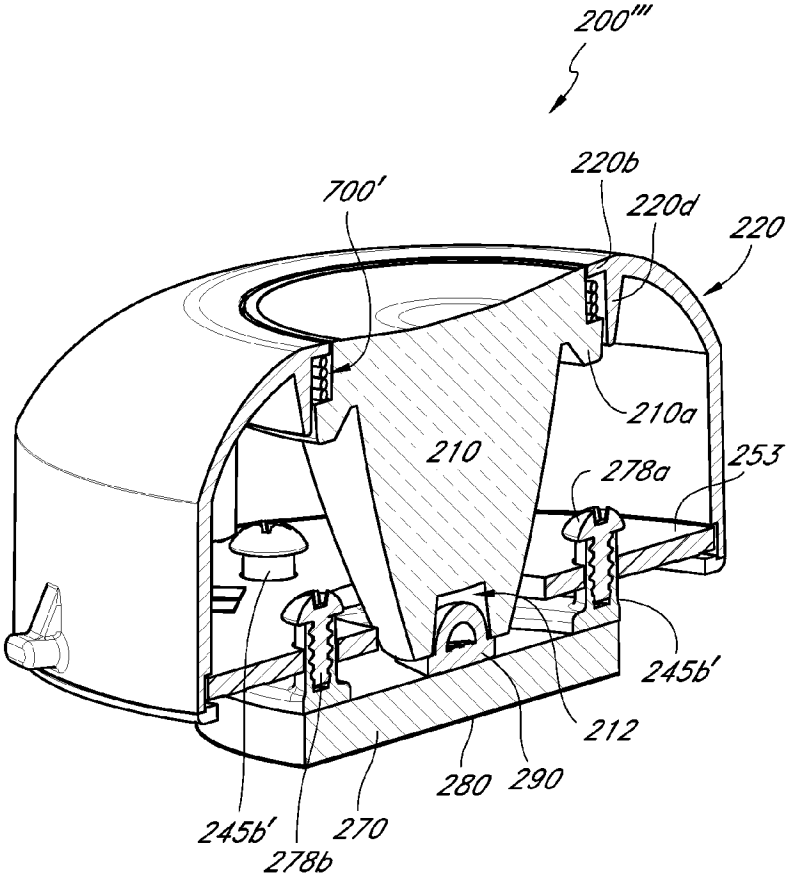
FIG. 18B is a schematic cross-sectional side view of the LED light module of FIG. 17A in a compressed position.
Figure 18A:
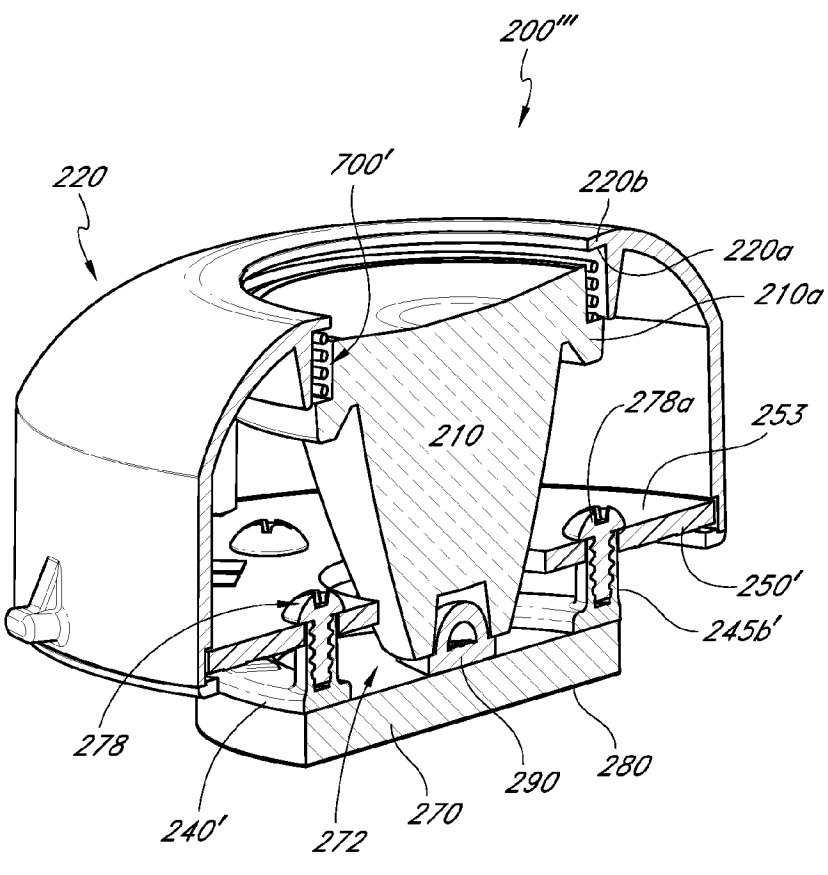
FIG. 18A is a schematic cross-sectional side view of the LED light module of FIG. 17A in an uncompressed position.

In the illustrated embodiment, the resilient member 700' is a coil spring. However, in other embodiments, the resilient member 700' can be other suitable springs, such as a leaf spring (e.g., stamped leaf spring) or other compression spring. The resilient member 700' is held in place between the shoulder 210*a* of the optic 210 and the underside surface 220*a* of the shoulder 220*b* of the housing 220. Additionally, the resilient member 700' is also held in place in an annular space defined between the optic 210 and the annular projection 220*d* of the housing 220. As shown in FIGS. 18A-18B, the optic 210 is attached to the LED 290 and thermal interface member 270' so that the optic 210, LED 290 and thermal interface member 270' move as one piece. In the uncompressed position, the shoulder 210*a* of the optic 210 is axially spaced apart from the underside surface 220*a*, with the resilient member 700' disposed axially therebetween. In one embodiment, the resilient member 700' is pre-compressed so that it exerts a force on the shoulder 210*a* of the optic 210 even when the LED light module 200''' is in the uncompressed position (see FIG. 18A).

With continued reference to FIGS. 17A-18B, the LED light module 200''' differs from the LED light module assemblies 200', 200" in that it does not have an optic retainer, such as the optic retainer 230 of the LED light module 200', or a resilient member with resilient elements attached to the thermal interface member 270', such as the resilient member 260 with resilient elements 263 of the LED light assemblies 200', 200".

The LED light module 200''' has a printed circuit board (PCB) 250' with a central opening 251*c* through which at least a portion of the optic 210 can extend. The circuit board 250' can also have one or more apertures 254 formed therethrough and sized to allow passage of a corresponding boss 245*b'* of the lower retaining member 240' therethrough. In the illustrated embodiment, the circuit board 250' has four apertures 254 disposed circumferentially about the opening 251*c* proximate the inner edge of annular the circuit board 250'. However, in another embodiment, the circuit board 250' can have more or fewer apertures 254, and the apertures 254 can be formed in other locations on the circuit board 250'. The circuit board 250' can also have one or more electrical components 256, such as diodes, capacitors, etc., mounted thereon. As shown in FIGS. 17A-18A, the circuit board 250' can have a wattage adjust control 258 mounted thereon that can be operated by a user to adjust the wattage of the LED light module 200'''. The wattage adjust control 258 can extend through an opening 228 in the housing 220. In one embodiment, the wattage adjust control 258 can be manually actuated by a user. In another embodiment, the wattage adjust control 258 can be remotely operated by the user (e.g., with a remote control that actuates the wattage adjust control 258 wirelessly, such as with RF signals).

As discussed above, the lower retaining member 240' can have one or more bosses 245*b'* that correspond to the apertures 254 in the circuit board 250', where the bosses 245*b'* can slidably extend through the apertures 254. The bosses 245*b'* can be threaded to receive fasteners 278 therein, to thereby fasten the circuit board 250' to the lower retaining member 240'. In another embodiment, the fasteners 278 can couple to the bosses 245b' in other suitable manners (e.g., press-fit) and need not be threadably coupled. At least one of the fasteners 278 can have a head 278a with a larger diameter than a body 278b of the fastener 278 so that the head 278a contacts the surface of the circuit board 250' and functions as a stop to limit the travel of the lower retaining member 240' away from the circuit board 250'. The lower retaining member 240' can also have one or more compression limiter tabs 242' on a surface thereof that faces the circuit board 250'. The compression limiter tabs 242' can limit the travel of the lower retaining member 240' toward the circuit board 250'.

Figure 17B:
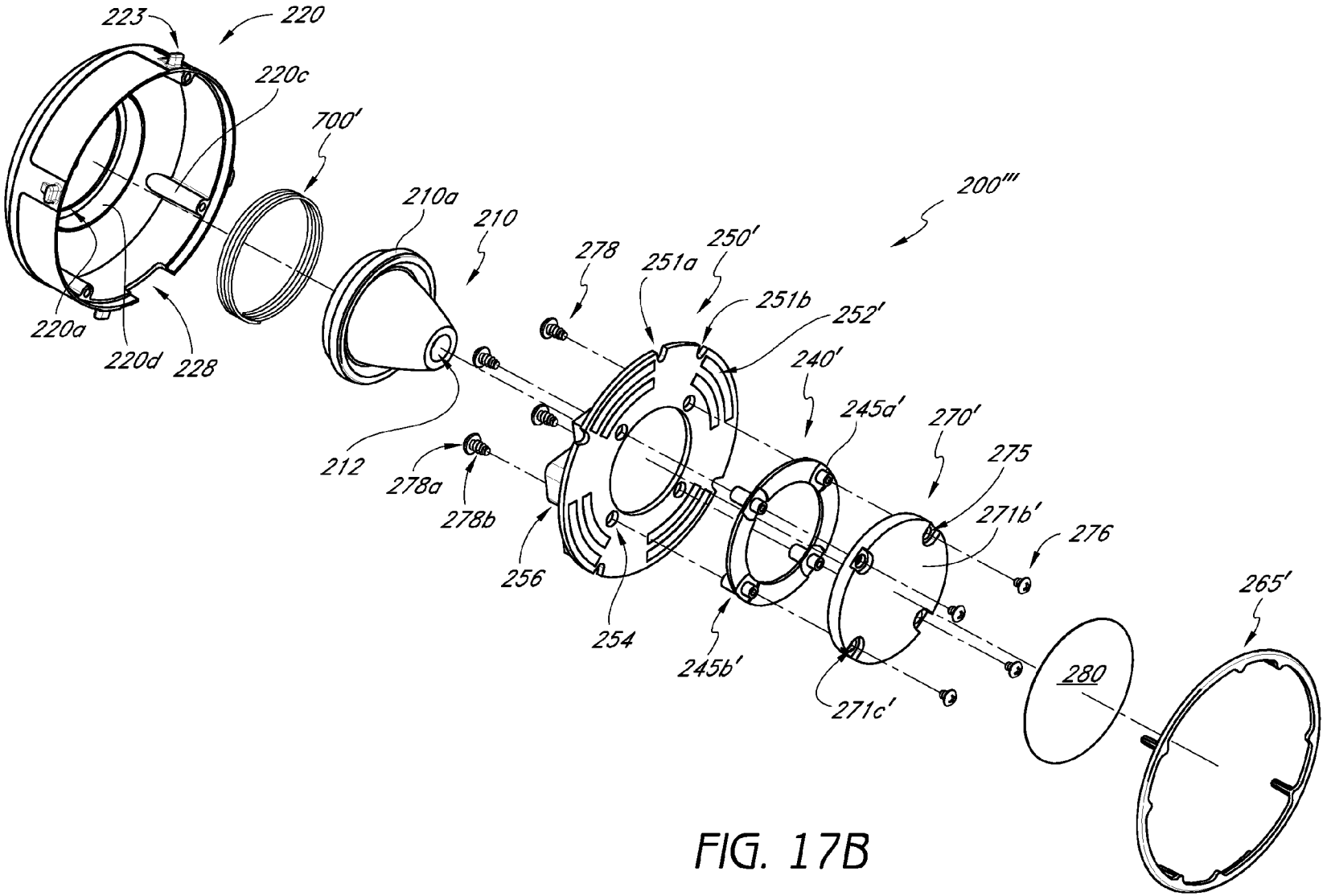
FIG. 17B is a schematic perspective rear exploded view of the LED light module of FIG. 17A.

As shown in FIG. 17B, the circuit board 250' can have one or more electrical contact members 252' that can contact corresponding electrical contact elements in a socket when the LED light module 200''' is coupled to the socket. In one embodiment, the electrical contact members 252' can be strips disposed circumferentially along a bottom surface of the circuit board 250'. However, in another embodiment, the electrical contact members 252' can have other suitable shapes. In one embodiment, where the electrical contact members 252' are strips, the strips can be gold plated. However, the electrical contact members 252' can be made of any suitable electrically conductive material. Further details on electrical contact members and the coupling of electrical contact members on the circuit board with corresponding electrical contact elements on a socket can be found in U.S. application Ser. No. 12/409,409 filed Mar. 23, 2009, the entirety of which is incorporated by references herein and should be considered a part of this specification.

The lower retaining member 240' also has one or more lower bosses 245a' sized to extend through openings 275' in the thermal interface member 270'. The lower bosses 245a' can be threaded to receive corresponding fasteners 276 therein to thereby fasten the thermal interface member 270' to the lower retaining member 240'. Once threaded to the lower bosses 245a', the fasteners 276 can sit in recesses 271c' on a bottom surface 271b' of the thermal interface member 270'. In another embodiment, the fasteners 276 can couple to the lower bosses 245a' in other suitable manners (e.g., press-fit) and need not be threadably coupled. In another embodiment, the lower retaining member 240' and thermal interface member 270' can attached to each other (e.g., via an adhesive, welds), so that the lower bosses 245a' and fasteners 276 are omitted. In still another embodiment, the lower retaining member 240' and thermal interface member 270' can be one piece.

The LED light module 200''' can also have an upper retaining member 265'. In the illustrated embodiment, the upper retaining member 265' can be ring-shaped and have one or more primary positioning elements 264a' and one or more secondary positioning elements 264b'. The primary and secondary positioning elements 264a', 264b' are sized to pass through corresponding recesses 251a, 251b in the circuit board 250' to thereby hold the circuit board 250' in a fixed orientation (e.g., inhibit rotation of the circuit boards 250') relative to the upper retaining member 265'. Additionally, the primary positioning elements 264a' are sized to extend into apertures in corresponding bosses 220c in the housing 220 to thereby couple the upper retaining member 265' to the housing 220. The coupling of the upper retaining member 265' to the housing 220 holds the circuit board 250' and housing 220 in a fixed orientation relative to the upper retaining member 265', so that the upper retaining member 265', circuit board 250' and housing 220 rotate together as one unit, for example, when the LED light module 200''' is coupled to the socket 300.

With reference to FIGS. 18A-18B, the LED light module 200''' can be moved from an uncompressed position (FIG. 18A) to a compressed position (FIG. 18B), for example, as the LED light module 200''' is coupled to a corresponding socket. In the uncompressed position, as shown in FIG. 18A, the resilient member 700' exerts a force on the shoulder 210a of the optic 210 that urges the optic 210 away from the shoulder 220b of the housing 220. As discussed above, the optic 210 is attached to the LED 290 and thermal interface member 270', so that as the optic 210 is urged away from the shoulder 220b, the thermal interface member 270' is likewise urged away from the shoulder 220b. The travel of the thermal interface member 270' and lower retaining member 240' away from the circuit board 250' is limited by the head portion 278a of the fasteners 278, which abut against the surface 253 of the circuit board 250'.

As the LED light module 200''' is moved to the compressed position, as shown in FIG. 18B, for example, via coupling with a socket 300 so that the thermal interface member 270' contacts a corresponding interface surface on the socket 300 and/or heat sink 500 or thermally conductive housing 400, the thermal interface member 270' is urged toward the shoulder 220b of the housing 220. This causes the optic 210 to be urged toward the shoulder 220b, which results in the compression of the resilient member 700' between the shoulder 210a of the optic 210 and the underside surface 220a. The compression of the resilient member 700' generates a compression force that is exerted against the thermal interface member 270' via the optic 210 to achieve the resilient thermal coupling between the LED light module 200''' and the socket and/or heat sink 500 or thermally conductive housing 400. Additionally, because the fasteners 278 are coupled to the bosses 245b', but not the circuit board 250', and because the apertures 254 are sized to slidingly receive the bosses 245b' therein, the bosses 245b' extend through the apertures 254 when the LED light module 200''' is in the compressed position so that the head portion 278a of the fastener 278 is spaced apart from the surface 253 of the circuit board 250'.

Accordingly, in the illustrated embodiment, the resilient member 700' disposed between the optic 210 and the housing 220 provides the sole mechanism for generating the compression force that urges the thermal interface member 270' against a corresponding interface surface in the socket and/or heat sink 500 or thermally conductive housing 400 when the LED light module 200''' is coupled to the same. Unlike the LED light module assemblies 200, 200', 200'', the LED light module 200''' does not include the resilient members 260 or resilient elements 263 that attach to the thermal interface member 270 for generating such a compression force.

One of ordinary skill in the art will recognize that the LED light module assemblies 200, 200', 200'', 200''' described above can all be coupled to a socket, such as the socket 300 described herein, and/or to a heat sink, such as the heat sink 500 described herein, or a thermally conductive housing, such as the thermally conductive housings 400, 620 described herein. Additionally, one of skill in the art will recognize that some drawings omit some components to facilitate the illustration of a particular feature (e.g., FIGS. 18A-18B do not show electrical components 256), but nonetheless such omitted components can be included. Further still, one of skill in the art will recognize that features in each of the embodiments described above for the LED light module can be applied to the other embodiments for the LED light module, and their application is not limited to the particular embodiment with which they are described.

Of course, the foregoing description is that of certain features, aspects and advantages of the present invention, to which various changes and modifications can be made without departing from the spirit and scope of the present invention. Moreover, the LED light module assembly need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed LED light module.

What is claimed is:

1. A lighting assembly, comprising:

a socket attachable to a heat dissipating member, said socket comprising one or more electrical contact elements accessed via one or more openings in the socket, said one or more openings extending along at least a portion of a circumference of the socket; and an LED light module removably coupleable to the socket, comprising:

an LED lighting element; and one or more electrical contact members configured to extend into the one or more openings in the socket to releasably contact the one or more electrical contact elements of the socket when the LED light module is coupled to the socket, said LED light module electrical contact members configured such that they will establish an operative electrical connection with the socket; and one or more resilient members of the LED light module or socket configured to apply a force between the LED light module and a least a portion or an element of the heat dissipating member when the LED light module is axially inserted at least partially into the socket such that the one or more electrical contact members extend into the one or more openings and when the LED light module is rotated relative to the socket, following said axial insertion, such that the one or more electrical contact members move along the one or more openings to thereby contact the one or more electrical contact elements of the socket.

2. The lighting assembly of claim 1, wherein said one or more electrical contact members of the LED light module extend from a surface of the LED light module.

3. The lighting assembly of claim 1, wherein the one or more electrical contact members of the LED light module comprises a pair of electrical contact posts, each of the electrical contact posts configured to releasably contact one of the electrical contact elements of the socket to establish an electrical connection between the LED light module and the socket.

4. The lighting assembly of claim 1, wherein the heat dissipating member comprises a thermally conductive housing.

5. The lighting assembly of claim 1, wherein the one or more electrical contact members comprise electrical contact strips.

6. The lighting assembly of claim 1, wherein the one or more resilient members comprise a plurality of leaf springs.

7. The lighting assembly of claim 1, wherein the one or more resilient members comprises a resilient member disposed between a distal end of the LED light module and a proximal end of the LED light module.

8. The lighting assembly of claim 1, wherein the one or more resilient members comprises a compression spring.

9. The lighting assembly of claim 8, wherein the compression spring is a coil spring.

10. A lighting assembly, comprising:

a heat dissipating member;

a socket attachable to the heat dissipating member, said socket comprising one or more electrical contact elements accessed via one or openings in the socket; and an LED light module removably coupleable to the socket, comprising:

an LED lighting element; and one or more electrical contact members configured to extend into the one or more openings in the socket to releasably contact the one or more electrical contact elements of the socket when the LED light module is coupled to the socket, said LED light module electrical contact members configured to establish an operative electrical connection with the socket; and one or more resilient members of the LED light module or socket configured to gradually compress as the LED light module is axially inserted at least partially into the socket and then rotated relative to the socket such that the one or more electrical contact members move along the one or more openings into contact with the one or more electrical contact elements of the socket, the one or more resilient members configured to apply a force between the LED light module and a least a portion or an element of the heat dissipating member during one or both of said axial insertion and/or rotation of the LED light module relative to the socket.

11. The lighting assembly of claim 10, wherein said one or more electrical contact members of the LED light module extend from a surface of the LED light module.

12. The lighting assembly of claim 10, wherein the one or more electrical contact members of the LED light module comprises a pair of electrical contact posts, each of the electrical contact posts configured to releasably contact one of the electrical contact elements of the socket to establish an electrical connection between the LED light module and the socket.

13. The lighting assembly of claim 12, wherein each of the pair of electrical contacts provides a positive or negative electrical contact.

14. The lighting assembly of claim 12, wherein each of the pair of electrical contacts provides a positive or negative electrical contact.

15. The lighting assembly of claim 10, wherein the heat dissipating member comprises a thermally conductive housing.

16. The lighting assembly of claim 10, wherein the one or more electrical contact members comprise electrical contact strips.

17. The lighting assembly of claim 10, wherein the one or more resilient members comprise a plurality of leaf springs.

18. The lighting assembly of claim 10, wherein the one or more resilient members comprises a resilient member disposed between a distal end of the LED light module and a proximal end of the LED light module.

19. The lighting assembly of claim 10, wherein the one or more resilient members comprises a compression spring.

20. The lighting assembly of claim 19, wherein the compression spring is a coil spring.

* * * * *

UNITED STATES PATENT AND TRADEMARK OFFICE

CERTIFICATE OF CORRECTION

PATENT NO. : 8,783,938 B2
APPLICATION NO. : 13/854854
DATED : July 22, 2014
INVENTOR(S) : Clayton Alexander It is certified that error appears in the above-identified patent and that said Letters Patent is hereby corrected as shown below:

In the Specification

At column 2, line 39, delete “a least” and insert -- at least --, therefor.

At column 3, line 2-3, delete “a least” and insert -- at least --, therefor.

In the Claims

At column 23, line 42 in Claim 1, delete “a least” and insert -- at least --, therefor.

At column 24, line 34 in Claim 10, delete “a least” and insert -- at least --, therefor.

Signed and Sealed this
Seventh Day of April, 2015

Michelle K. Lee

Michelle K. Lee
*Director of the United States Patent and Trademark Office*